US007208684B2

(12) United States Patent
Fetterolf, Sr. et al.

(10) Patent No.: US 7,208,684 B2
(45) **Date of Patent: *Apr. 24, 2007**

(54) INSULATED, HIGH VOLTAGE POWER CABLE FOR USE WITH LOW POWER SIGNAL CONDUCTORS IN CONDUIT

(75) Inventors: James R. Fetterolf, Sr., Mechanicsburg, PA (US); Charles S. Blichasz, Boiling Springs, PA (US); William L. Donmoyer, Grantville, PA (US); Arthur H. Heuer, Cleveland Heights, OH (US); Alberto E. Planas, Sr., Miami Beach, FL (US); Alberto E. Planas, Jr., Coral Gables, FL (US)

(73) Assignee: Ulectra Corporation, North Miami Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/934,198

(22) Filed: Sep. 3, 2004

(65) Prior Publication Data

US 2006/0021787 A1 Feb. 2, 2006

Related U.S. Application Data

(63) Continuation-in-part of application No. 10/903,756, filed on Jul. 30, 2004, now Pat. No. 6,998,538.

(51) Int. Cl.
*H01B 11/02* (2006.01)

(52) U.S. Cl. ..... 174/113 R

(58) Field of Classification Search ..... 174/113 R, 174/120 R, 116, 105 R, 36, 102 R
See application file for complete search history.

(56) References Cited

U.S. PATENT DOCUMENTS 2,089,774 A 8/1937 Wachstein
2,141,290 A 12/1938 Carlson et al.

(Continued)

FOREIGN PATENT DOCUMENTS

JP 2004-111178 * 4/2004

OTHER PUBLICATIONS

Twenty pages downloaded from Kabelwerk Eupen AG web site having the domain name www.eupen.com. The downloaded pages describe electrical cables denoted as EMC cables. Publication date unknown. According to Kabelwerk Eupen AG, its EMC cable technology has been used in cable applications over the last 10 years.

(Continued)

*Primary Examiner*—Chau N. Nguyen
(74) *Attorney, Agent, or Firm*—Tarolli, Sundheim, Covell & Tummino LLP

(57) ABSTRACT

The present invention is directed to a high voltage, insulated electrical power cable suitable for use adjacent to one or more low power signal communications conductors in metal or plastic conduit or raceway. In one preferred embodiment, the power cable includes a first group of one or more conductors for supplying power and a power conductor insulation jacket enclosing the first group of one or more conductors. The power conductor insulation jacket includes a soft magnetic material that functions as an electromagnetic field shield in the radio frequency range of approximately 1 megahertz to 400 megahertz thereby protecting the integrity of signals transmitted on the adjacent signal communications conductors.

18 Claims, 9 Drawing Sheets

U.S. PATENT DOCUMENTS

| | | | | |
|---|---|---|---|---|
| 2,180,731 | A | 11/1939 | Dickinson | |
| 2,391,036 | A | 12/1945 | Rasmussen | |
| 2,583,025 | A | 1/1952 | Swift et al. | |
| 3,123,765 | A | 3/1964 | Julie | |
| 3,328,510 | A | 6/1967 | White | |
| 4,284,841 | A | 8/1981 | Tijunelis et al. | |
| 4,453,031 | A | 6/1984 | Justiss | |
| 4,506,235 | A * | 3/1985 | Mayer | 333/12 |
| 4,675,474 | A * | 6/1987 | Neuroth | 174/102 R |
| 4,843,356 | A | 6/1989 | Lusignan et al. | |
| 4,956,523 | A | 9/1990 | Pawluk | |
| 5,085,715 | A | 2/1992 | Tokunaga et al. | |
| 5,287,074 | A | 2/1994 | Meguro et al. | |
| 5,352,301 | A | 10/1994 | Panchanathan et al. | |
| 5,371,823 | A | 12/1994 | Barrett et al. | |
| 5,414,217 | A | 5/1995 | Neuroth et al. | |
| 5,416,457 | A | 5/1995 | Nakatsuka et al. | |
| 5,427,734 | A | 6/1995 | Yamashita et al. | |
| 5,448,669 | A | 9/1995 | Dunn et al. | |
| 5,451,718 | A | 9/1995 | Dixon | |
| 5,716,460 | A | 2/1998 | Manning et al. | |
| 6,114,632 | A | 9/2000 | Planas, Sr. et al. | |
| 6,132,635 | A | 10/2000 | Taguchi et al. | |
| 6,255,813 | B1 | 7/2001 | Isomura et al. | |
| 6,369,318 | B1 | 4/2002 | Uchida et al. | |
| 2001/0040043 | A1 | 11/2001 | Ortiz et al. | |
| 2001/0042632 | A1 | 11/2001 | Manov et al. | |
| 2001/0048983 | A1 | 12/2001 | Yoshida et al. | |
| 2002/0035170 | A1 | 3/2002 | Glatkowski et al. | |
| 2002/0037054 | A1 | 3/2002 | Schurig | |
| 2002/0037376 | A1 | 3/2002 | Fenton | |
| 2003/0121694 | A1* | 7/2003 | Grogl et al. | 174/113 R |
| 2005/0001249 | A1* | 1/2005 | Anthony et al. | 257/295 |
| 2005/0057320 | A1* | 3/2005 | Brandt et al. | 333/24 R |

OTHER PUBLICATIONS

Eighteen page product catalog for EMC electrical cables manufactured by Kabelwerk Eupen AG. Product catalog was downloaded from www.eupen.com web site. Publication date unknown. However, according to Kabelwerk Eupen AG, its EMC cable technology has been used in cable applications over the last 10 years.

Pages i-viii, 1-4 and 71-101 from Raytheon owner's manual entitled *Pathfinder SL 70 Series Radar Owner's Handbook, Raytheon Marine Company* (now Raymarine Limited) (www.raymarine.com), Manchester, New Hampshire. Publication date Aug. 18, 1998. Upon information and belief, the inter-unit cable coupling the Raytheon scanner or antenna and the Raytheon radar display unit is a cable including both power conductors and data conductors in a single cable. The inter-unit cable is described on pp. 74-75.

Two page article entitled "The Risk of Unwanted EMI—How Common Mode Noise is Generated, An How to Combat It" authored by Hank Hinrichs, *Magnetics Business & Technology* magazine. Publication date Mar. 2002.

Thirty-two pages from a technical manual entitled *Permanent Magnet Guidelines*, (MMPA PMG-88) published by Magnetic Materials Producers Association, Chicago, IL 60603 (available for downloading from www.MMPA.org website). Publication date Dec. 1987.

Pages 50-108 from *Elements of Engineering Electromagnetics*, Second Edition (Chapter 2), authored by Nannapaneni Narayana Roa, Prentice Hall, Inc., Englewood Cliffs, NJ. Copyright 1987.

Two pages downloaded on Nov. 3, 2004 from Vitek Performance, Inc. web site having the domain name www.vitekperformance.com. The downloaded pages describe Vitek's marine ignition wires which purportedly include a coating of ferrite-impregnated latex. Printout of text cut-off in screen shot is provided. Publication date at least as early as Nov. 3, 2004.

Two pages downloaded on Nov. 3, 2004 from FDK Corporation web site having the domain name www.fdk.com. The downloaded pages describe FDK's USB-type interface ferrite data cables for EMI suppression. Printout of text cut-off in screen shot is provided. Publication date at least as early as Nov. 3, 2004.

PCT International Search Report of PCT/US05/31581, International Filing Date of Sep. 2, 2005 (Form PCT/ISA/210) 3 Pages. This PCT Applicationcorres. to U.S. Appl. No. 10/934,198.

* cited by examiner

| Cable Type | Transient Voltage(V) | Data Rate(Mbps) | Total Time Lost | Remarks |
|---|---|---|---|---|
| Simtra cable | 4400 | 10 | 0 | -- |
| Simtra cable | 4400 | 100 | 0 | -- |
| Simtra cable | 2500 | 100 | 0 | -- |
| Simtra cable | 3500 | 100 | 0 | -- |
| Simtra cable | 3500 | 100 | 0 | With shield connected. |
| Simtra cable | 3500 | 100 | 0 | With shield connected, but ground not driven. |
| Simtra cable | 3500 | 1000 | 100 ① | With shield connected. |
| Simtra cable | 2500 | 1000 | 100 ① | With shield connected. |
| Simtra cable | 2500 | 1000 | 0.23 | -- |
| Simtra cable | 1000 | 1000 | 0 | -- |
| Simtra cable | 500 | 1000 | 0 | -- |
| Simtra cable | 750 | 1000 | 0 | -- |
| Simtra cable | 900 | 1000 | 0 | -- |
| Simtra cable | 750 | 1000 | 0 | In grounded steel conduit. |
| Simtra cable | 1000 | 1000 | 0 | In grounded steel conduit. |
| THHN x3 | 4400 | 10 | 74 | -- |
| THHN x3 | 2500 | 10 | 2 | -- |
| THHN x3 | 4400 | 100 | 365 | -- |
| THHN x3 | 2500 | 100 | 366 | -- |
| THHN x3 | 1000 | 100 | 365 | -- |
| THHN x3 | 500 | 100 | 244 | -- |
| THHN x3 | 4400 | 1000 | 365 | -- |
| THHN x3 | 2500 | 1000 | 366 | -- |
| THHN x3 | 1000 | 1000 | 366 | -- |
| THHN x3 | 500 | 1000 | 366 | -- |
| Simtra cable | 4400 | 1000 | 365 | In grounded steel conduit. |
| Simtra cable | 4400 | 1000 | 365 | In ungrounded steel conduit. |
| NMB Cable | 4400 | 1000 | 365 | |
| NMB Cable | 2500 | 1000 | 366 | |
| NMB Cable | 1000 | 1000 | 366 | |
| NMB Cable | 500 | 1000 | 366 | |
| NMB Cable | 4400 | 100 | 364 | |
| NMB Cable | 2500 | 100 | 364 | |
| NMB Cable | 1000 | 100 | 365 | |
| NMB Cable | 500 | 100 | 182 | |
| NMB Cable | 4400 | 10 | 60 | |
| NMB Cable | 2500 | 10 | 1 | |
| NMB Cable | 1000 | 10 | 0 | |
| NMB Cable | 500 | 10 | 0 | |

①Approximate Value

Fig.9

INSULATED, HIGH VOLTAGE POWER CABLE FOR USE WITH LOW POWER SIGNAL CONDUCTORS IN CONDUIT

CROSS REFERENCE TO RELATED APPLICATION

The application is a continuation-in-part of U.S. application Ser. No. 10/903,756, entitled INTEGRATED POWER AND DATA INSULATED ELECTRICAL CABLE HAVING METALLIC OUTER JACKET, filed on Jul. 30, 2004, now issued as U.S. Pat. No. 6,998,538 on Feb. 14, 2006.

FIELD OF THE INVENTION

The present invention is directed to an insulated electrical power cable suitable for use in metal or plastic conduit or raceway in proximity to one or more groups of low power signal conductors and, more particularly, to an insulated electrical power cable including a group of one or more power conductors encased in an insulation jacket including a soft magnetic material which functions to protect the integrity of signals transmitted on the one or more groups of low power signal conductors by absorbing radio frequency (RF) electromagnetic emissions generated by high voltage, high frequency electrical transients which may be present on one or more power conductors of the power cables due to external high frequency electrical disturbances.

BACKGROUND ART

U.S. Pat. No. 6,114,632, issued on Sep. 5, 2000 to Planas, Sr. et al. ("the '632 patent") disclosed a hybrid electrical cable. A hybrid electrical cable is an integrated, insulated electrical cable that combines both power conductors and voice/data signal conductors overlaid by an outer insulating sheath or jacket. The '632 patent hybrid cable included a first group of one or more conductors for transmitting AC power and a second group of one or more conductors for transmitting voice or data signals. Because of the proximity of the power conductors and the voice/data conductors, shielding and/or isolating the data/voice conductors from electromagnetic emissions emitted by the power conductors was of paramount concern. A first insulation sheath enclosed the first group of one or more power conductors. A second insulation sheath enclosed the second group of voice/data signal conductors.

The '632 patent disclosed that the first and second insulation sheaths included an inner layer of organic compound material and outer layer of magnetic material. The magnetic material preferably was barium ferrite. The barium ferrite layer in the first and second insulation sheaths advantageously isolated the second group of voice/data conductors from the magnetic field generated by the first group of power conductors.

The advantages of providing a single integrated cable having both power and voice/data conductors has obvious cost and installation advantages compared with utilizing two or more separate power, data and/or voice lines or cables. The '632 patent is incorporated in its entirety herein by reference.

While the hybrid cable disclosed in the '632 patent represented a significant advance over state of the art electrical cables, additional improvements were desirable, including making a cable having improved electromagnetic absorption and shielding capabilities, greater power and data capacity and being easier and less costly to manufacture.

What is desired is a hybrid cable with improved electromagnetic absorption and shielding capabilities, greater power and data capacity and which is efficient to manufacture.

Additionally, in spite of the obvious advantages of a hybrid cable capable of high voltage power transmission and low power signal transmission on a unitary structure cable, there are certain situations in which is it desirable to install a high voltage power cable adjacent low voltage signal conductors in metal or plastic conduit or raceway. For example, in an existing commercial or industrial building that utilizes metal or plastic conduit or raceway to route power conductors, it would be very advantageous to use the existing conduit or raceway systems to route both high voltage power (via a power cable) and low power signal conductors (via one or more signal conductors or cables) thereby providing both power and voice/data transmission via the existing conduit/raceway system.

One problem encountered with running power and data/voice signal conductors in the same conduit is the fill ratio for metal and plastic conduit set forth in the National Electrical Code (N.E.C.). The fill ratio limit means that the total cross sectional area of all conductors (including insulation jackets and sheaths) routed through a section of conduit must be less than specified amount of the internal cross sectional area of the conduit.

An even more serious problem encountered with an adjacent arrangement of power conductors and data/voice signal conductors within a section of conduit is that of loss or disruption of signal transmission that would result from external high frequency transients imposed on one or more of the power conductors of the power cable, e.g., a high frequency transient caused by lightening hitting a power line coupled to the power cable. Because of the proximity of the power cable and the signal conductors disposed in the conduit or raceway, such a high frequency transient traveling along the power cable is likely to interfere with low power signals in proximity to the transient thereby causing a serious loss of signal integrity on the low power signal conductors. Indeed most electrical codes forbid the use of power conductors adjacent data conductors in a section of conduit unless there is proper shielding of the power conductors to protect the signal conductors from such transients.

What is also needed is a high voltage power conductor cable that can be utilized adjacent one or more low power signal conductors in a length of metal or plastic conduit or raceway. More specifically, what is desired is a power conductor cable that has a minimum cross sectional area for conduit fill ratio purposes and that has sufficient electromagnetic field shielding to reduce the probability that high frequency transients imposed on the power cable will cause significant loss of data/voice/control signals being transmitted on low power signal conductors adjacent the power cable.

SUMMARY OF THE INVENTION

In one preferred embodiment, a hybrid electrical cable of the present invention includes one or more power cables suitable for high voltage transmission/distribution of electrical power and one or more groups of low power signal conductors used for data, voice and/or control transmissions/communications such as, but not limited to, twisted pairs of conductors, multi-conductor cables such as Cat5e data cable, coaxial cable, optical fiber cable ("signal conductors"). As used herein, "high voltage" means a voltage magnitude of 30 volts or more while "low power" means a power magnitude of 5 watts or less.

Each of the power cables includes a group of power conductors. For each power cable, the group of power conductors is overlaid by a power cable insulation jacket or sheath comprising a binder material and a soft magnetic material.

Optionally, the hybrid electrical cable further includes a flexible wrapping to bind together the one or more power cables and the one or more groups of signal conductors. The wrapping material may be a skip binding material fabricated from a polymer such as, for example, KEVLAR® thread or, alternatively, a polymer tape material such as, for example, MYLAR® tape.

The hybrid electrical cable additionally includes a flexible metallic outer jacket or sheath overlying the one or more power cables and the one or more groups of signal conductors. While, the hybrid electrical cable of the present invention is contemplated to be used in wiring applications where its flexibility is a necessary or desirable attribute, alternately, depending upon the application, the metallic outer jacket of the hybrid electrical cable may be rigid.

As noted above, for each of the one or more power cables, the power cable insulation jacket includes an inner layer comprising a soft magnetic material dispersed in an insulating polymer or elastomer binder material. The soft magnetic material of the power cable insulation jacket functions as a magnetic field absorber (an absorptive choke) in the radio frequency range of approximately 1 megahertz (MHz) to 400 MHz. A soft magnetic material is a material that is magnetized when introduced into a magnetic field, but retains very little of its magnetization in the absence of the magnetic field. As used herein, a "soft magnetic material" is defined as a material that has a coercivity of 1 oersted or less, when measured as a solid. Preferably, the soft magnetic material is a soft ferrite magnetic material. One suitable soft ferrite magnetic material which is commercially available is manganese zinc ferrite powder. The soft ferrite magnetic material is a high temperature dielectric and the polymer or elastomer binder is also a dielectric thereby providing a dielectric layer of resistive material between the power cable power conductors and the external environment. The polymer or elastomer binder also functions to keep the soft magnetic material together and flexible and allow the inner layer of the insulation jacket to be extruded.

The power cable insulation jacket further includes an outer insulating layer, such as polyvinyl chloride (PVC), overlying the soft magnetic material and binder material. The outer insulating layer functions as another high resistivity dielectric layer between the power cable power conductors and the external environment. The insulating layer further functions as a containment vessel for the soft magnetic material and binder material. This containment function is important in the event that the soft magnetic material and binder degrade and break apart over harsh or prolonged use.

The group of signal conductors may include one or more pairs of insulated twisted pairs of conductors, coaxial cable, optical fiber and/or other low power signal conductors known to those of skill in the art.

Preferably, the metallic outer jacket comprises a thin, flexible steel jacket. The outer metallic jacket may be spirally wound or may be fabricated of any number of metallic coverings including metal tape, metal foil, flexible metal tubing, braided wires/tapes, parallel wires/tapes and other metallic coverings known to those of skill in the art. The metallic jacket is comprised of a magnetic material or paramagnetic material (such as aluminum) and is grounded. The metallic jacket protects the group of signal conductors from externally induced electromagnetic emissions such as externally induced RF noise up to approximately 1 gigahertz (GHz).

Thus, in the hybrid cable of the present invention, the signals carried by the one or more groups of signal conductors are protected from both internally and externally generated electromagnetic emissions. The soft magnetic material overlying the power cable power conductors protects, by RF absorption, the one or more groups of signal conductors from electromagnetic emissions emitted by the power conductors due to high voltage, high frequency electrical transients imposed on one or more of the power conductors by external electrical disturbances such as lightening and other high frequency power disturbances.

Additionally, the grounded outer metallic jacket shields, by electrostatic shielding, the one or more groups of low power signal conductors from electromagnetic emissions generated by external sources in proximity to the hybrid cable. Additionally, the metallic jacket advantageously eliminates the need for metal or plastic conduit when installing the hybrid cable in a commercial or residential building, since the metallic jacket functions as its own metal conduit for building and electrical code purposes.

In one aspect of a first embodiment of the present invention, a hybrid electrical cable provides for high voltage power transmission and/or distribution and low power signal transmission. The hybrid electrical cable includes:

a) a power cable including a group of one or more high voltage power conductors for conducting high voltage power;

b) a group of one or more low power signal conductors;

c) a power cable insulation jacket overlying the group of one or more power conductors, the power conductor insulation jacket including a soft magnetic material having a coercivity of 1 oersted or less; and d) a metallic outer jacket overlying the power cable insulation jacket and the group of one or more low power signal conductors.

In a second preferred embodiment of the hybrid cable of the present invention, the hybrid cable includes one or more high voltage power cables. Each power cable includes one or more power conductors. For each of the one or more power cables, each of the power conductors includes an insulation jacket. The power conductor insulation jacket includes an inner layer of soft magnetic material and binder material and an outer layer of insulating material such as PVC.

The hybrid cable also includes one or more groups of low power signal conductors. The hybrid electrical cable additionally includes a flexible metallic outer jacket or sheath overlying the flexible wrapping material. The flexible metallic outer jacket may be a spiral wound metal jacket.

In one aspect of a second preferred embodiment of the present invention, a hybrid electrical cable provides for high voltage power transmission and/or distribution and low power signal transmission. The hybrid electrical cable includes:

a) a power cable including a group of one or more high voltage power conductors for conducting high voltage power, each power conductor of the group of one or more high voltage power conductors further including a power conductor insulation jacket overlying the power conductor, the power conductor insulation jacket including a soft magnetic material having a coercivity of 1 oersted or less;

b) a group of one or more low power signal conductors; and c) a metallic outer jacket overlying the power cable and the group of one or more low power signal conductors.

In a third preferred embodiment of the hybrid cable of the present invention, the hybrid cable includes one or more high voltage power cables and one or more groups of signal conductors. Each power cable includes one or more power conductors. Each of the one or more power cables includes an insulation jacket. The power cable insulation jacket includes an inner layer of soft magnetic material and binder material and an outer layer of insulating material such as PVC.

The hybrid electrical cable additionally includes a flexible outer jacket or sheath overlying the one or more power cables and one or more groups of signal conductors. The outer jacket includes an inner layer or wrap of grounded metallic shielding. For grounding purposes, a drain wire is electrically coupled to the metal shielding, the drain wire being coupled to ground. The power cable insulation jacket further includes a middle layer of soft magnetic material and binding material which encases the metal shielding layer. The soft magnetic material of the middle layer functions as a common mode choke, converting any high frequency transients traveling along the metal shielding to heat and thereby maintaining the integrity of signals being transmitted on the one or more signal conductors. The outer jacket additionally includes an outer layer of insulating material such as PVC or polytetrafluoroethylene (PTFE) which encases the soft magnetic material/binding material layer.

In one aspect of a third preferred embodiment of the present invention, a hybrid electrical cable provides for high voltage power transmission and/or distribution and low power signal transmission. The hybrid electrical cable includes:

a) a power cable including a group of one or more high voltage power conductors for conducting high voltage power;

b) a group of one or more low power signal conductors; and c) a power cable insulation jacket overlying the group of one or more power conductors, the power conductor insulation jacket including an inner layer of soft magnetic material having a coercivity of 1 oersted or less; and d) an outer jacket overlying the power cable insulation jacket and the group of one or more signal conductors, the outer jacket including an inner layer of grounded metallic shielding, a middle layer of soft magnetic material having a coercivity of 1 oersted or less and an outer insulating layer.

In a fourth preferred embodiment of the hybrid cable of the present invention, the hybrid cable includes one or more high voltage power cables and one or more groups of signal conductors. Each power cable includes one or more power conductors. For each of the one or more power cables, each of the power conductors includes an insulation jacket. The power conductor insulation jacket includes an inner layer of soft magnetic material and binder material and an outer layer of insulating material such as PVC. For each power cable, a power cable insulation jacket surrounds the one or more power conductors of the cable.

The hybrid electrical cable additionally includes an outer jacket or sheath overlying and binding together the one or more power cables and the one or more groups of signal conductors. The outer jacket includes an inner layer comprising grounded metallic shielding. A drain wire, coupled to ground, is electrically coupled to the metal shielding for positive grounding of the shielding. The power cable insulation jacket further includes a layer of soft magnetic material and binding material which encases the metallic shielding. The outer jacket additionally includes an outer layer of insulating material such as PVC or PTFE which encases the soft magnetic material/binding material layer.

In one aspect of a fourth preferred embodiment of the present invention, a hybrid electrical cable provides for high voltage power transmission and/or distribution and low power signal transmission. The hybrid electrical cable includes:

a) a power cable including a group of one or more high voltage power conductors for conducting high voltage power, each power conductor of the group of one or more high voltage power conductors further including a power conductor insulation jacket overlying the power conductor, the power conductor insulation jacket including a soft magnetic material having a coercivity of 1 oersted or less;

b) a group of one or more low power signal conductors; and c) an outer jacket overlying the power cable insulation jacket and the group of one or more signal conductors, the outer jacket including an inner layer of grounded metallic shielding, a middle layer of soft magnetic material having a coercivity of 1 oersted or less, and an outer insulating layer.

In another aspect of the present invention, a high voltage power cable is provided for transmitting high voltage power and being suitable for use in a section of metal or plastic conduit or raceway in proximity to one or more groups of low power signal conductors. In one embodiment, the high voltage power cable of the present invention includes:

a) a group of one or more high voltage power conductors; and b) a power cable insulation jacket overlying the group of one or more power conductors and including a soft magnetic material having a coercivity of 1 oersted or less.

Preferably, the soft magnetic material of the power cable insulation jacket comprises a soft ferrite magnetic material which is embedded in an extrusible binder material and extruded over the group of one or more power conductors to form a first insulation layer. Optionally, the power cable insulation jacket further includes a grounded metallic layer overlying the first layer.

In a second embodiment, the high voltage power cable of the present invention includes:

a) a group of one or more high voltage power conductors; and b) for each power conductor of the group of one or more high voltage power conductors, a power conductor insulation jacket overlying the power conductor, the power conductor insulation jacket including a soft magnetic material having a coercivity of 1 oersted or less.

For each power conductor insulation jacket, the soft magnetic material preferably comprises a soft ferrite magnetic material which is embedded in an extrusible binder material and extruded over a respective power conductor of the group of one or more power conductors. Optionally, the cable may include a grounded metallic layer overlying the group of the one or more power conductors and the respective power conductor insulation jackets.

In another aspect, the present invention features a combination of a high voltage power conductor electrical cable, a group of one or more low power signal conductors and a section of conduit defining a longitudinal interior region, the power conductor electrical cable and the group of one or more signal conductors installed within the section of conduit and extending together along at least a portion of the longitudinal interior region of the section of conduit. The combination includes:

a) the section of conduit;

b) the group of one or more low power signal conductors; and c) the power conductor electrical cable suitable for transmitting high voltage power and including a group of one or more power conductors and a power cable insulation jacket overlying the group of one or more power conductors, the power cable insulation jacket comprising a soft magnetic material and a binder material, the soft magnetic material having a coercivity of 1 oersted or less.

In another aspect, the present invention features a combination of a high voltage power conductor electrical cable, a group of one or more low power signal conductors, separate from the power cable, and a section of conduit defining a longitudinal interior region, the power conductor electrical cable and the group of one or more low power signal conductors installed within the section of conduit and extending together along at least a portion of the longitudinal interior region of the section of conduit, the combination comprising:

a) the section of conduit;

b) the group of one or more low power signal conductors; and c) the power conductor electrical cable suitable for transmitting high voltage power and including a group of one or more power conductors, for each power conductor of the group of one or more power conductors, a power conductor insulation jacket overlying the power conductor, the power conductor insulation jacket including a soft magnetic material having a coercivity of 1 oersted or less.

These and other objects, features and advantages of the invention will become better understood from the detailed description of the preferred embodiments of the invention which are described in conjunction with the accompanying drawings.

BRIEF DESCRIPTION OF THE DRAWINGS

FIG. 9 is a listing of test results of the cut away view of an electrical fast transient test of a power cable coated with a soft magnetic material.

DETAILED DESCRIPTION

Hybrid Cable—First Preferred Embodiment

Figure 1:
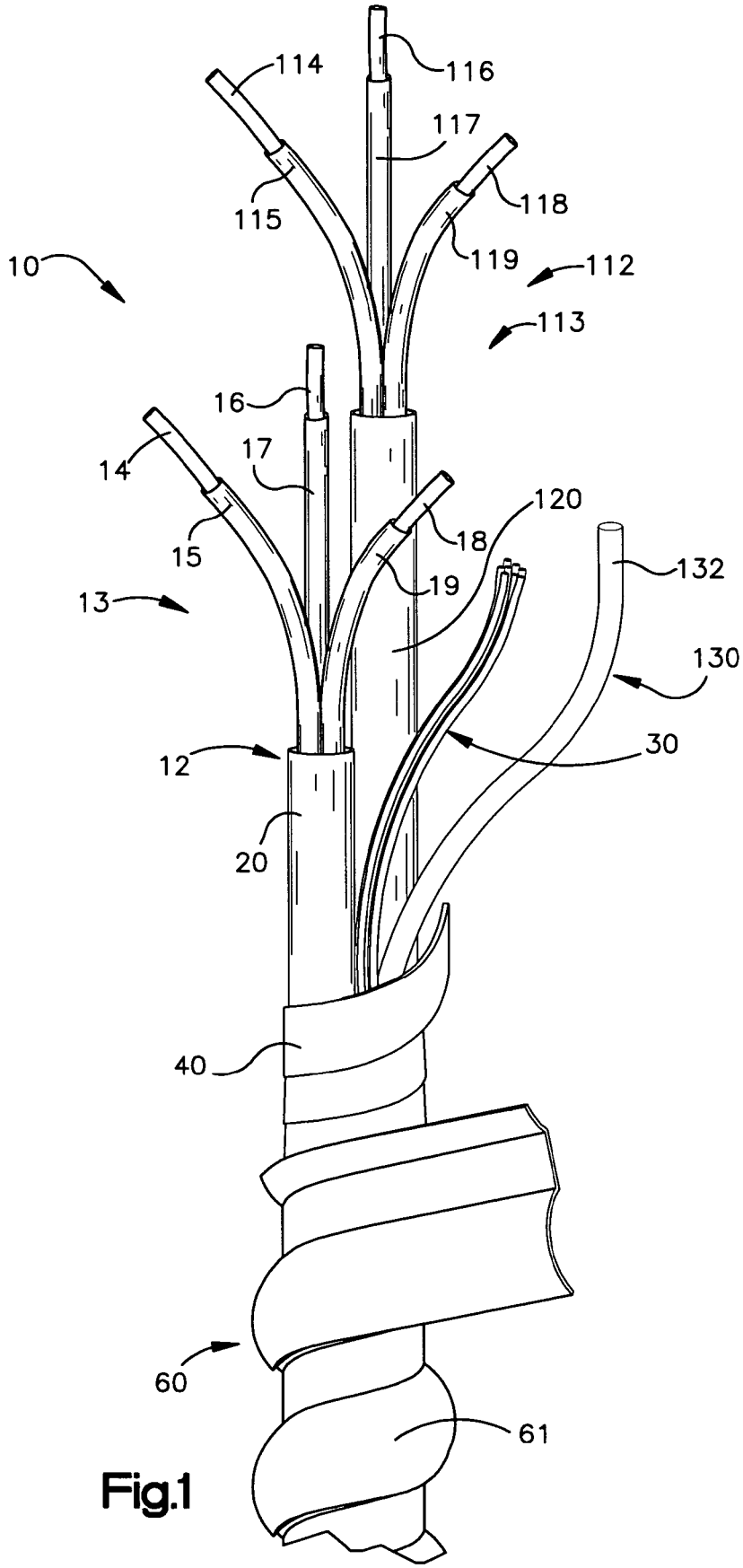
FIG. 1 is a schematic cut away view of a section of a first preferred embodiment of a hybrid electrical cable of the present invention.
Figure 2:
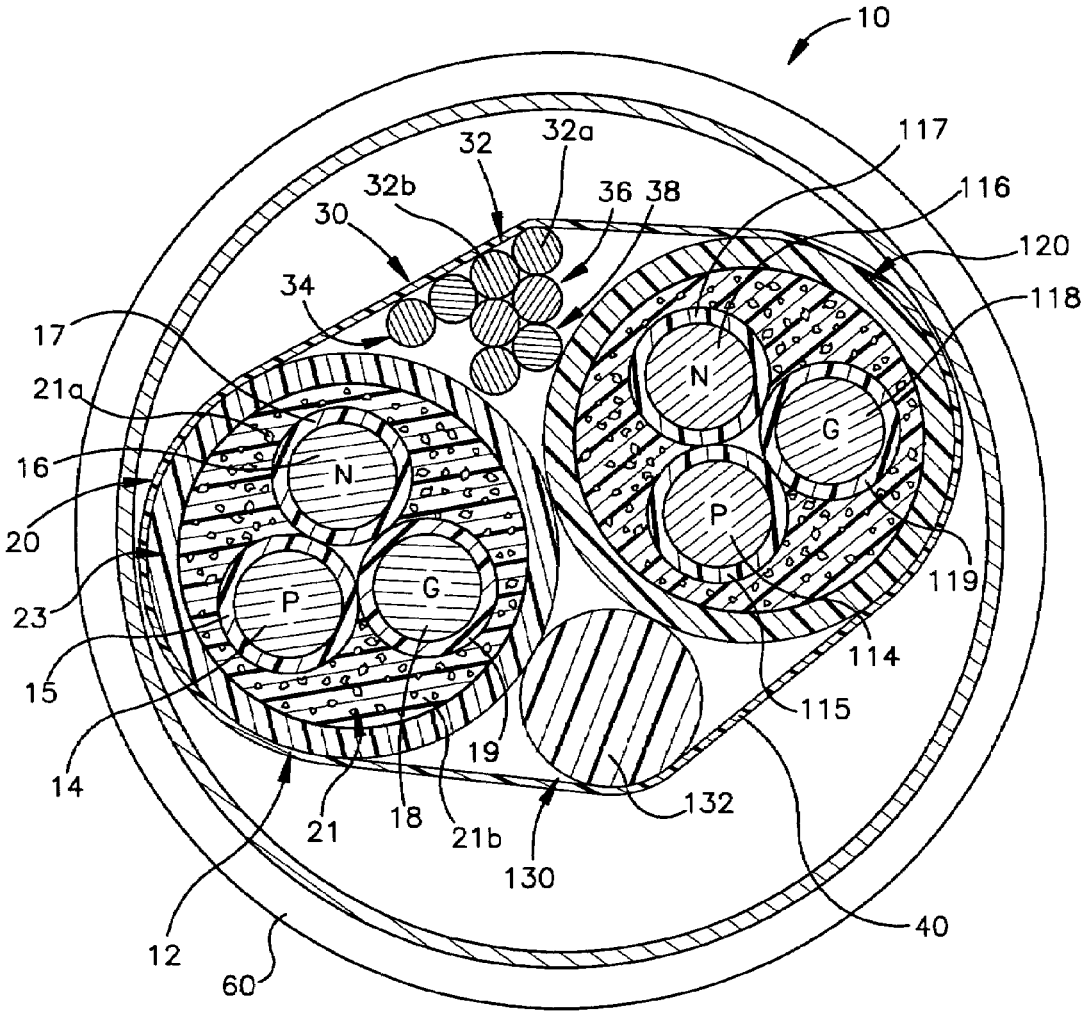
FIG. 2 is a schematic axial sectional view of the hybrid cable of FIG. 1.

A first preferred embodiment of the hybrid cable of the present invention is shown generally at 10 in FIGS. 1 and 2. The hybrid cable 10 may advantageously be employed in local and wide area computer networks where it necessary to transmit both power and multiple data/voice/control signals along parallel paths and in close proximity. However, it should be recognized that the cable 10 may be advantageously used in any electrical or electronic equipment or systems that requires power transmission and/or distribution (inside and/or outside a facility) and for communication of digital or analog signals for linking, networking or sharing/transmitting data and/or voice signals.

The data/voice/control signals being transmitted may include a variety of low power signals including data, voice, and other signals such as fire alarm, security, closed circuit TV, and further includes, without limitation, telecommunications, telephone, fax, e-mail, internet, ethernet, video, images, music, sound, light, monitoring, and control signals and other known to those of skill in the art.

One major use of the hybrid cable 10 will be providing for both high voltage power (e.g., 120V AC, 240V AC, 277V AC, 208–480V AC or 48V DC) and low power data and/or voice and/or control signal communications. As used herein, high voltage power is defined as 30 V or more (AC or DC) in accord with the National Electric Code, while low power signal communications are defined as those communications and/or transmissions involving 5 watts or less of power.

In one preferred embodiment, the hybrid cable 10 includes at least one power cable. In the particular exemplary embodiment shown in FIGS. 1–3, the hybrid cable 10 includes two power cables 12, 112. It should be recognized that the hybrid cable of the present invention may include any number (one or more) of power cables and/or power conductors. Each power cable 12, 112 includes at least one high voltage power conductor. In the exemplary embodiment shown in FIGS. 1–3, each of the two power cables 12, 112 includes a group of three power conductors 13, 113. The hybrid cable 10 also includes one or more groups of low power signal conductors (hereafter "signal conductors").

Figure 3:
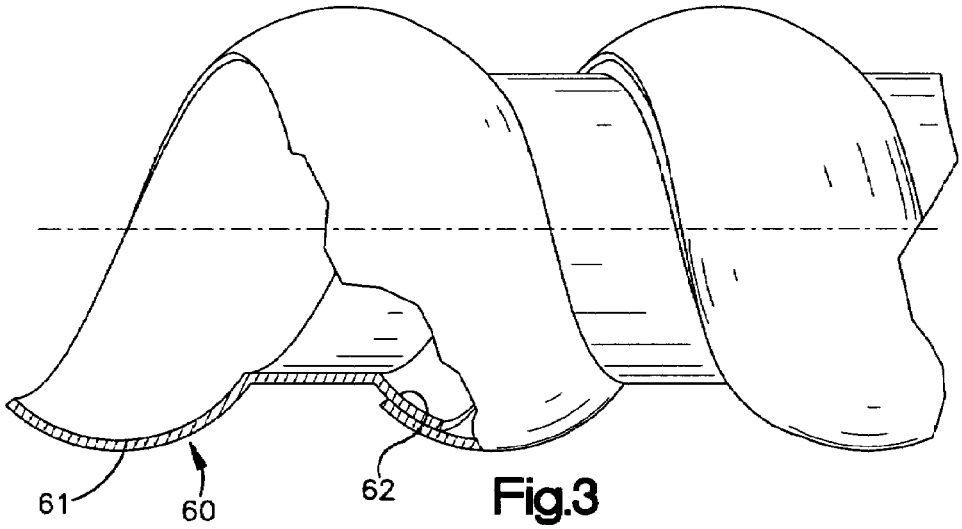
FIG. 3 is a schematic view partially in section and partially in front elevation of a metallic outer jacket or sheath of the hybrid cable of FIG. 1.

In the exemplary embodiment shown in FIGS. 1–3, there are two groups of signal conductors 30, 130. Again, it should be recognized that the hybrid cable of the present invention may include any number (one or more) of groups of signal conductors and each group may include any number (one or more) of conductors.

For each of power cables 12, 112, its respective group of power conductors 13, 113 includes one or more individually insulated copper conductors. Typically, each group of power conductors 13, 113 includes three conductors, a power conductor 14, 114, a neutral conductor 16, 116 and an isolated grounding conductor 18, 118, as is typical for 120 V AC power distribution. For three phase AC power distribution or transmission (e.g., 220–440 V three phase AC), the power conductors 14, 16, 18 and 114, 116, 118, respectively, correspond to conductors for phases A, B, C of the three phase AC power. For DC power circuits, the power conductors 14, 16, 18 and 114, 116, 118, respectively, correspond to conductors +V, −V, and ground. It should be appreciated that the conductors 14, 16, 18 and 114, 116, 118 may be solid or stranded copper conductors and that conductor materials other than copper may be used if required by an application. Further, it should be appreciated the number of power conductors may be greater than three if required by a particular application or the number of power conductors may be one or two, again depending on the specific application.

The hybrid cable 10 of the present invention contemplates use with one or more power conductors. Each of the power conductors 14, 114 includes an insulation layer 15, 115 comprising an organic compound insulating material, such as PVC, sheathed on the outside with a nylon layer or jacket. For each of the groups of power conductors 13, 113, the neutral conductor 16, 116 is insulated with an insulation layer 17, 117 comprising PVC overlaid by a nylon jacket, similar to the PVC and nylon insulation layer 15, 115 of the power carrying conductor 14, 114. For each of the groups of power conductors 13, 113, the isolated grounding conductor 18, 118 is insulated with an insulation layer 19, 119 comprising PVC overlaid by a nylon jacket, also similar to the PVC and nylon insulation layer 15, 115 of the power carrying conductor 14, 114.

For each of the power cables, 12, 112, the group of three power conductors 13, 113 is encased in an insulation jacket 20, 120. Each power cable insulation jacket 20, 120 is identical in composition and only the insulation jacket 20 of power cable 12 will be described herein. The power cable insulation jacket 20 comprises an inner or shielding layer 21 and an overlying outer layer 23. The inner layer 21 comprises a soft magnetic material 21*a* suspended in a flexible binder material 21*b*. The soft magnetic material 21*a* functions as an electromagnetic field shield in the radio frequency range of approximately 1 megahertz to 400 megahertz suspended or mixed into a binder material. A soft magnetic material is one which is magnetized when introduced into a magnetic field, but retains very little of its magnetization in the absence of the magnetic field. Preferably, the soft magnetic material 21*a* of the inner layer 21 is a soft ferrite magnetic material.

As defined herein, the soft magnetic material 21*a* is one which has a coercivity of 1 oersted or less, when measured as a solid. Coercivity (Hc) is the property of a magnetic material that is measured by the coercive force which corresponds to the saturation induction for the material. The coercive force is that value of magnetizing force required to reduce the flux density to zero (Hc). A more detailed explanation of magnetic terms, including coercivity, is provided in Chapter 2 of *Elements of Engineering Electromagnetics*, Second Edition, by Nannapaneni Narayana Roa, published by Prentice-Hall, Inc., Englewood Cliffs, N.J. (1987). The aforementioned *Elements of Engineering Electromagnetics* book is incorporated herein in its entirety by reference.

There are many suitable soft ferrite magnetic materials including, but not limited to, manganese zinc ferrite (Mn—Zn—$Fe_2O_3$). Such soft ferrite magnetic materials, including manganese zinc ferrite, are typically sold in the form magnetic components and also sold in powdered form, which is commercially from various supplies including Steward, Inc. (Steward Advanced Materials) of Chattanooga, Tenn. 37401 (www.stewardmaterials.com).

The soft magnetic material 21*a* is suspended in an elastomer or polymer binder 21*b*. One suitable polymer binder would be a thermoplastic such as polyvinyl chloride (PVC). A suitable elastomer binder would be silicon rubber. The soft ferrite magnetic material 21*a* is a high temperature dielectric and the polymer or elastomer binder 21*b* is also a dielectric thereby providing a dielectric layer of resistive material between the power cable power conductors 13 and the external environment. Manganese zinc ferrite is a brittle material which, as mentioned above, is sold in the form magnetic components and also in powdered form. The polymer or elastomer binder 21*b* also functions to encapsulate and provide flexibility of the powdered soft magnetic material 21*a*. Preferably, the inner layer 21 is an extrusible composition that is efficiently applied over the group of power conductors 13 by an extrusion process.

If it is desired to apply the inner layer 21 via extrusion and if the soft magnetic material 21*a* is obtained in powdered form, it is preferable to have a range of particle sizes of the soft magnetic material 21*a* in the extrusion mixture, up to a diameter of about 250 microns. The ratio by weight of the soft magnetic material 21*a* to the binder material 21*b* will vary with the application, the materials and the extrusion equipment. A weight ratio of 50%–50% to 70:30% is a reasonable starting point. The specific application will determine the required thickness of the soft magnetic material inner layer 21, typical thickness of the inner layer is in the range of 0.005–0.050 inch. Upon extrusion, the inner layer 21 will include small particles of soft magnetic material 21*a* randomly interspersed or distributed in the binder material 21*b*, as is shown schematically in FIG. 2.

The inner soft magnetic material layer 21 is overlaid by an outer layer or jacket 23 of an organic compound material which functions to encapsulate the inner layer 21. The outer layer 23 advantageously functions as another high resistivity dielectric layer between the power cable power conductors 13 and the external environment. The insulating layer 23 further functions as a containment vessel for the soft magnetic material and binder material layer 21. This containment function is important in the event that the soft magnetic material and binder layer 21 degrades and breaks apart over harsh or prolonged use of the cable 10. The thickness of the outer layer 23 is again dependent upon the application. A range of 0.005–0.050 inch is typical. Preferably, the organic compound material of the outer layer 23 is PVC or silicon rubber and is applied overlying the inner layer 21 by extrusion.

The soft magnetic material 21*a* overlying the power cable power conductors 14, 16, 18 protects, by RF absorption, the groups of signals conductors 30, 130 from electromagnetic emissions emitted by the power conductors due to high voltage, high frequency electrical transients imposed on one or more of the power conductors by high frequency external electrical disturbances. Stated another way, the soft magnetic material 21*a* of the inner layer 21 functions to absorb or block the magnetic field generated by the group of power conductors 13 thereby isolating the first and second groups of signal conductors 30, 130 from the power conductor electromagnetic field. This magnetic isolation of the first and second group of signal conductors 30, 130 eliminates or reduces the magnitude of any induced voltages in the first and second group of signal conductors 30, 130 resulting from the electromagnetic field, thereby reducing the probability of faulty data or analog signal transmission by the groups of signal conductors 30, 130.

The soft magnetic material 21*a* is an electrically "lossy" material which means it converts the absorbed RF energy to heat. The soft magnetic material 21*a* performs more effectively at high frequencies. When high frequency electromagnetic energy is applied to a "lossy" material like the soft magnetic material 21*a*, the magnetic domains of the material flip or reverse polarity thereby converting high frequency RF energy to heat.

The first group of signal conductors 30 includes four pair of twisted pairs of conductors. The second group of signal conductors 130 includes an optical fiber conductor 132. It should be understood that the data and frequency requirements of the system that the cable 10 is being used in connection with will dictate the number and type of conductors needed in the groups of signal conductors 30, 130. Thus, depending on system and circuit requirements, there may be more or less than four twisted pairs of conductors in each of the group of signal conductors 30. It should also be recognized that the hybrid cable 10 of the present invention may include any number of groups of signal conductors, one group, two groups, three groups, four groups, etc. Further, it should be understood that each group of signal conductors of the hybrid cable 10 may include one or more of any type of signal conductors know to those of skill in the art including twisted pair, optical fiber, coaxial cable, etc. The hybrid cable 10 of the present invention is not limited to any specific type or number of data and/or voice and/or control conductors.

The first group of signal conductors 30 includes four pair of shielded, insulated twisted pair of conductors 32 (comprising conductors 32*a*, 32*b*), 34, 36, 38 equivalent to a category 5e type (Cat5e) twisted pair.

Optionally, the groups of power conductors 13, 113 and the groups of signal conductors 30, 130 may be overlaid and bound together by a flexible wrapping or binding jacket 40. The wrapping functions to protect the conductors 13, 113, 30, 130 from being cut and/or abraded by a metallic outer insulation sheath 60 and further provides a marking surface upon which a product identification number and/or other required markings may be imprinted. The wrapping 40 may comprise a thin polyester tape or film, such as MYLAR®, that is spirally wrapped around the groups of power conductors 13, 113 and the groups of signal conductors 30, 130. Advantageously, the wrapping tape or film layer 40 has a thickness of between 0.0005 and 0.001 thickness and a width of ½ inch. Alternately, the wrapping jacket 40 may be a material that is wrapped around the groups of power conductors 13, 113 and signal conductors 30, 130 in a skip binding configuration.

The outer insulation sheath or jacket 60 encases the cable core, i.e., the groups of power conductors 13, 113, the groups of signal conductors 30, 130 and the wrapping or binding jacket 40. The outer sheath 60 is comprised of a grounded magnetic or paramagnetic material, such as steel or aluminum. Preferably, the outer sheath 60 comprises thin, flexible metallic jacket having a thickness of approximately 0.005 inch and a width of approximately 0.500 inch. To allow limited flexibility, the metallic sheath 60 is spirally wound. The metallic sheath 60 may also be any number of other metallic wrappings or coverings such as metal tape, metal foil, flexible metal tubing, braided wire, helically wound parallel wires/tapes and other flexible metal structures known to those of skill in the art. The metallic sheath 60 is coupled to the ground.

A cross section of the steel material that is spirally wound to fabricate the outer sheath 60 is shown in FIG. 3. Each spiral of the sheath 60 overlaps the next so that if the cable 10 is flexed, i.e., flexed to extend around a corner, no gap is created between adjacent spirals of the sheath 60. As can be seen in FIG. 3, a raised region 61 of one spiral of the sheath overlies an end region 62 of the adjacent spiral.

The metallic sheath 60 is a magnetic material and, as such, protects the group of data and/or voice conductors from externally induced electromagnet emissions such as externally induced RF noise. The metallic sheath 60 functions to "bypass" harmful AC power induced fault currents and as an eddy current RF shielding path to ground for the twisted pairs of conductors 32, 34, 36, 38. Stated another way, the grounded outer metallic jacket or sheath 60 shields, by electrostatic shielding, the groups of low power signal conductors 30, 130 from electromagnetic emissions generated by external sources in proximity to the hybrid cable 10. Additionally, the metallic jacket 60 advantageously eliminates the need for metal or plastic conduit when installing the hybrid cable in a commercial or residential building, since the metallic jacket 60 functions as its own metal conduit for building and electrical code purposes.

Additionally, the hybrid cable 10 provides significant manufacturing and inventory advantages because it allows a large number of hybrid cable configurations to be manufactured on demand in response to a customer order with the necessity of having to maintain inventory for each possible configuration of the hybrid cable. A limited number of configurations of groups of power conductors and signal conductors will be pre-manufactured and stored in inventory permitting a large number of final hybrid cable configurations to be manufactured on an as needed basis. For example, if five different configurations of power cables were manufactured and stored in inventory and five different configurations of signal conductors were manufactured and stored in inventory and the hybrid cable could be manufactured with either one or two groups of signal conductors, a customer would have the choice of 50 different configurations of hybrid cable (5 types of power conductor configurations, 5 types of signal conductor configuration, and either one or two groups of signal configurations resulting in 5×5×2=50 possible hybrid cable configurations). These 50 hybrid cable configurations would be provided with only 10 stock keeping units (groups of conductors) maintained in inventory (the five configurations of groups of power conductors and the five configurations of the groups of signal conductors).

In response to a customer orders for one of the 50 hybrid cable configurations, the appropriate pre-manufactured group of power conductors and pre-manufactured group or groups of signal conductors would be selected from inventory, threaded though an extruder and the outer insulation sheath is extruded over the groups of power and signal conductors to produce the desired hybrid cable configuration on demand for the customer.

Hybrid Cable—Second Preferred Embodiment

Figure 5:
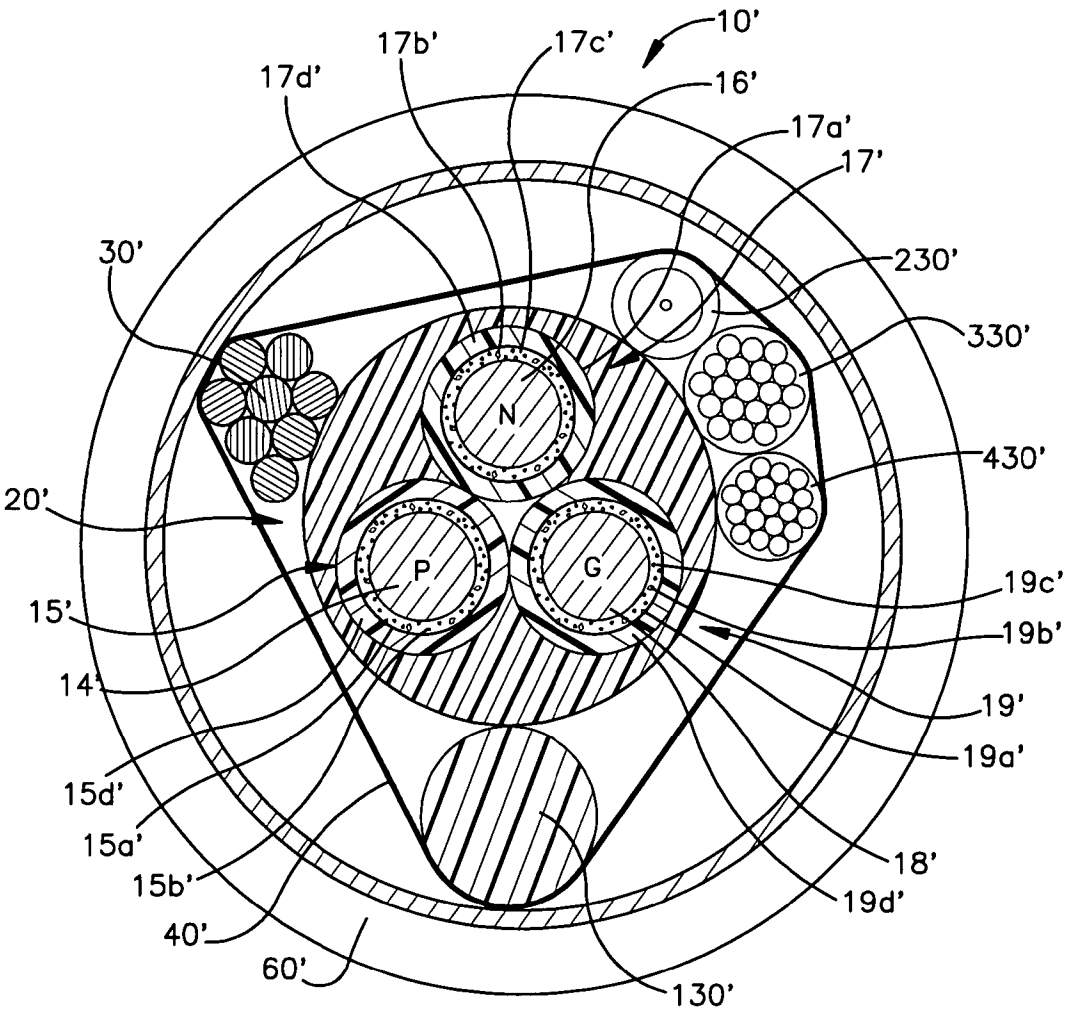
FIG. 5 is a schematic axial sectional view of a second preferred embodiment of a hybrid electrical cable of the present invention.
Figure 4:
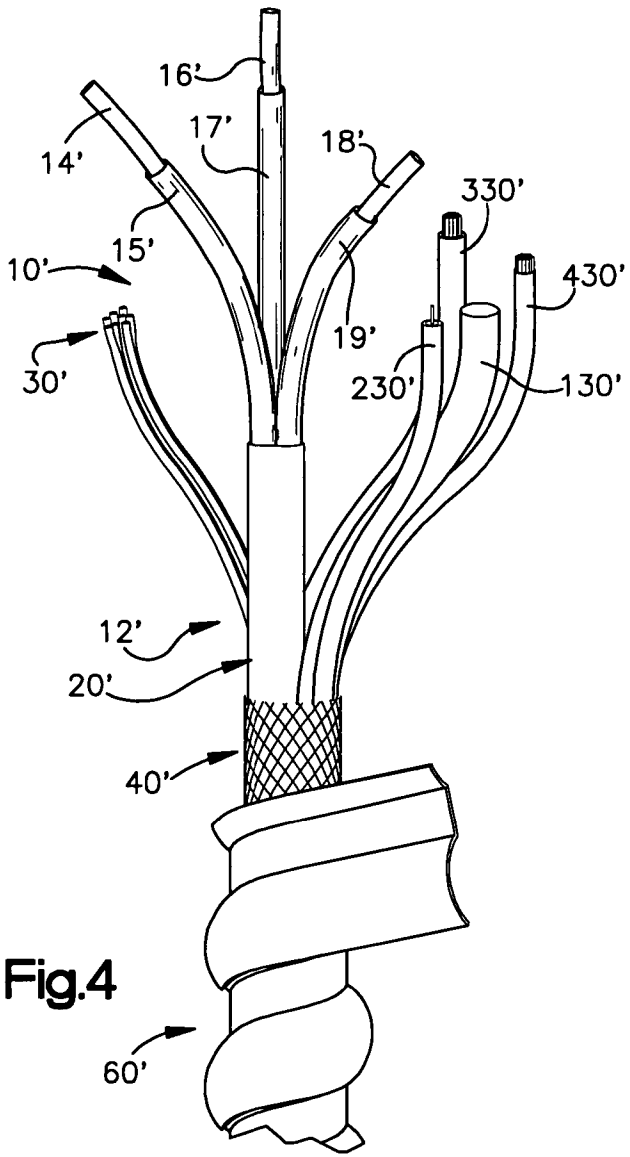
FIG. 4 is a schematic cut away view of a section of a second preferred embodiment of a hybrid electrical cable of the present invention.

A second preferred embodiment of the hybrid cable of the present invention is shown generally at 10' in FIGS. 4 and 5. Fundamentally, the hybrid cable 10' of the second preferred embodiment differs from the hybrid cable 10' of the first preferred embodiment in that, in the second preferred embodiment, the soft magnetic material 15*b*', 17*b*', 19*b*' is disposed in insulation layers 15*a*'. 17*a*', 19*a*' around each of the individual power conductors 14', 16', 18' of the power cable 12'. In the first embodiment, as described above, the soft magnetic material 21*a* was disposed in a single insulation layer 21 that surrounded all three of the power conductors 14, 16, 18.

In the second embodiment, the hybrid cable 10' includes the power cable 12' comprising the group of power conductors 13'. The hybrid cable 10' also includes five groups of data/voice conductors 30', 130', 230', 330', 430'.

The group of power conductors 13' includes the power conductor 14', the neutral conductor 16' and the isolated grounding conductor 18'. The power conductors 14', 16', 18' are similar to the power conductors 14, 16, 18 described in the first embodiment. Each of the power conductors 14', 16', 18' includes a respective insulation jacket 15', 17', 19'. Each of the power conductor insulation jackets 15', 17', 19' includes an inner layer 15*a*', 17*a*', 19*a*' and an outer layer 15*d*', 17*d*', 19*d*'.

The respective inner layers 15*a*', 17*a*', 19*a*' of the insulation jackets 15', 17', 19' comprise soft magnetic material 15*b*', 17*b*', 19*b*' mixed or interspersed in a binder material 15*c*', 17*c*', 19*c*'. The soft magnetic material 15*b*', 17*b*', 19*b*' is similar to the soft magnetic material 21*a* described in the first embodiment, while the binder material 15*c*', 16*c*', 19*c*' is similar to the binder material 21*b* of the first embodiment. The outer layers 15*d*', 17*d*', 19*d*' of the insulation jackets 15', 17', 19' is an insulating material such as the material described with respect to the outer layer 23 in the first embodiment.

The insulation jackets 15', 17', 19' perform the same shielding function as the insulation jacket 20 in the first embodiment, except that the insulation jackets 15', 17', 19' individually encase the each of the power conductors 14, 16, 18 instead of surrounding the group of three power conductors 13. One advantage of having the soft magnetic material layer 15*a*', 17*a*', 19*a*' individually surrounding each of the power conductors 14, 16, 18 instead of the group of three power conductions as in the first embodiment is manufacturing efficiency. Extruder nozzles are typically circular. Since the power conductors 14', 16', 18' are circular in cross section, it is much easier and efficient for the circular extruder nozzle to apply a uniform inner layer 15*a*', 17*a*', 19*a*' of material over the circular cross section of the power conductors 14', 16', 18'. By contrast, in the first embodiment, the power conductors 14, 16, 18 form a generally triangular shape which leads to non-uniformity in the thickness of the inner soft magnetic layer 21. This non-uniformity of layer thickness can easily be seen by an examination of FIG. 2. Further, the three power conductors 14, 16, 18 do not run parallel but rather are twined or twisted around each other during the manufacturing process so that the conductors remain together during subsequent processing operations thus aggravating the non-uniformity problem or requiring that the extruder nozzle spin at the same rate of the twisting of the conductors. Also, the coating of the individual conductors 14', 16', 18' may result in more effective RF absorption in certain applications.

Overlying the power conductor insulation jackets 15', 17', 19' is an organic insulation jacket 20'. The composition of the insulation jacket 20' is similar to the composition of the outer layer 23 of the first embodiment. The hybrid cable 10' also includes the five groups of signal conductors 30', 130', 230', 330', 430'. The first group of signal conductors 30' includes four pair of twisted wire conductors. The second group of signal conductors 130' includes an optical fiber conductor. The third group of signal conductors 230' includes a coaxial cable. The forth and fifth groups of signal conductors 330', 430' include Cat5e data cables.

Optionally, a flexible wrapping or binding jacket 40', similar to the wrapping jacket 40 of the first embodiment, may be used to bind together the power cable 12' and the groups of signal conductors 30', 130', 230', 330', 430'. The wrapping jacket 40' of the second embodiment is a skip binding material fabricated from a polymer such as, for example, KEVLAR® thread. Alternately, the binding jacket 40' may comprise a polymer tape material such as, for example, MYLAR® tape.

Finally, as in the first embodiment, the hybrid electrical cable 10' additionally includes a grounded flexible metallic outer jacket or sheath 60' overlying the flexible wrapping material 40'. The flexible metallic outer jacket 60' may be spiral wound metal.

Hybrid Cable—Third Preferred Embodiment

Figure 6:
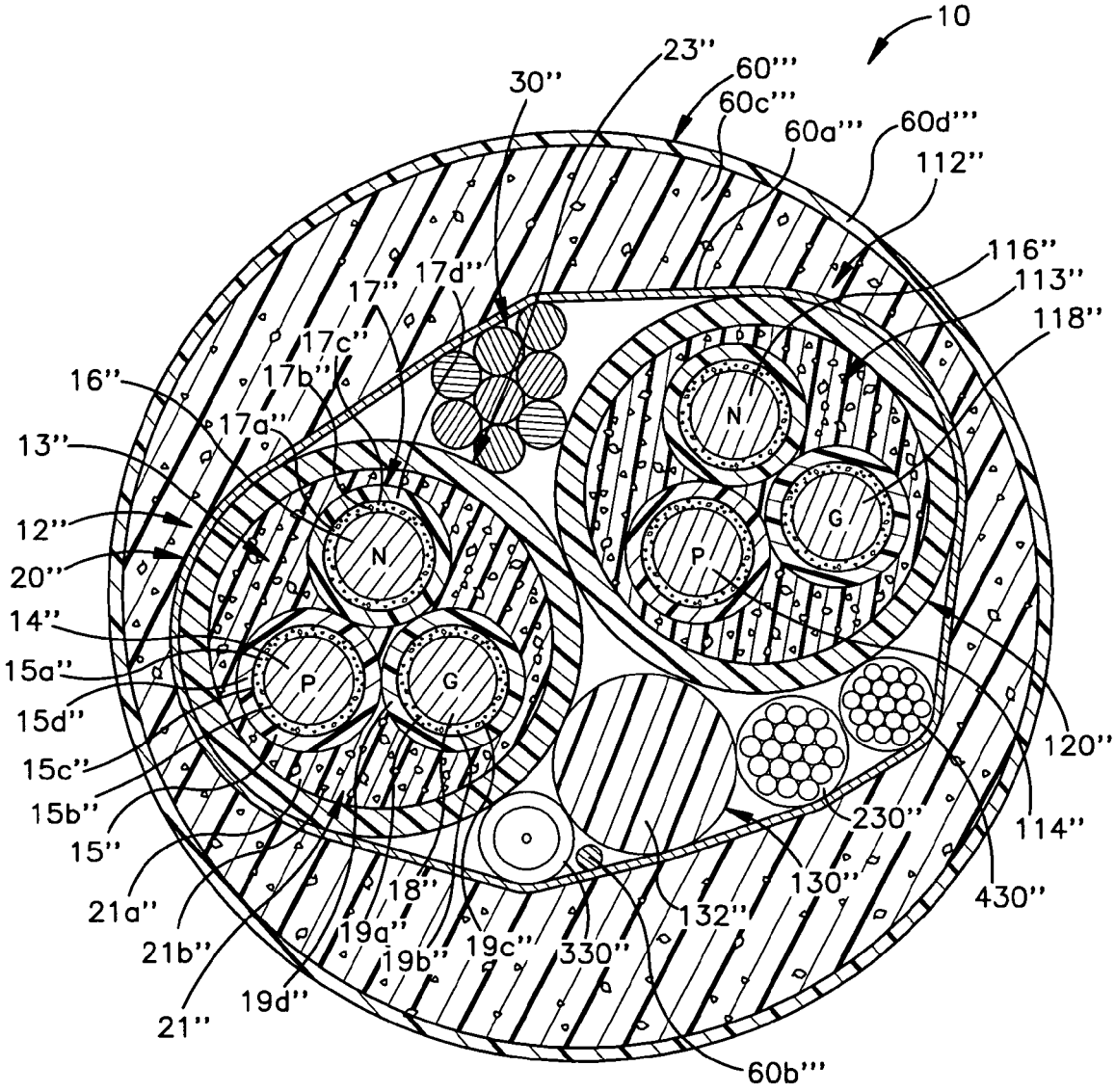
FIG. 6 is a schematic axial sectional view of a third preferred embodiment of a hybrid electrical cable of the present invention.

A third preferred embodiment of the hybrid cable of the present invention is shown generally at 10" in FIG. 6. Fundamentally, the hybrid cable 10" of the third preferred embodiment is similar to the hybrid cable 10 of the first embodiment with additions to the outer jacket 60. In the third embodiment, the hybrid cable 10" includes two power cables 12", 120" comprising respective groups of power conductors 13", 130". The hybrid cable 10" also includes five groups of signal conductors 30", 130", 230", 330", 430".

The group of power conductors 13" includes the power conductor 14", the neutral conductor 16" and the isolated grounding conductor 18". The power conductors 14", 16", 18" are similar to the power conductors 14, 16, 18 described in the first embodiment. Each of the power conductors 14", 16", 18" includes a respective insulation layer 15", 17", 19" similar to the insulation layers 15, 17, 19 of the first embodiment.

The second cable 112" includes the group of power conductors 113" comprising power conductors 114", 116", 118". The second cable 112" includes insulation layers 115", 117", 119" around each of the conductors 114", 116", 118", similar to the insulation jackets 15", 17", 19".

Additionally, as was the case in the first embodiment, the conductors of the respective power cables 12", 112" each are encased in a power cable insulation jacket 20", 120", similar to the power cable insulation jackets 20, 120 of the first embodiment. The power cable insulation jackets 20" and 120" are identical, so only the insulation jacket 20" will be described.

The power cable insulation jacket 20", like the insulation jacket 20 of the first embodiment, includes an inner layer 21" and an outer layer 23". The inner layer 21" is identical to the inner layer 21 of the first embodiment and includes a soft magnetic material 21*a*" mixed in a binder material 21*b*". The outer layer 23" is identical to the outer layer 23 of the first embodiment and comprises an organic insulating material.

The hybrid cable 10" also includes the five groups of signal conductors 30", 130", 230", 330", 430". The first group of signal conductors 30" includes four pair of twisted wire conductors. The second group of signal conductors 130" includes an optical fiber conductor. The third group of signal conductors 230" includes a coaxial cable. The forth and fifth groups of signal conductors 330", 430" include Cat5e data cables.

The hybrid electrical cable 10" additionally includes a flexible outer jacket or sheath 60" overlying the one or more power cables 12", 112" and one or more groups of signal conductors 30", 130", 230", 330", 430". The outer jacket 60" includes an inner layer 60*a*" of grounded metal shielding. The metal shielding 60*a*" is a magnetic or paramagnetic material. Preferably, the metal shielding 60*a*" is spirally wrapped around the one or more power cables and the one or more groups of signal conductors. To ground the metal shielding inner layer 60*a*", a drain wire 60*b*" is electrically coupled to the metal shielding layer 60*a*". Alternately, the drain wire 60*b*" may be eliminated if another means is used to couple the metal shielding inner layer 60*a*" to ground, for example, by crimping, soldering or welding the metal shielding 60*a*" to ground. The outer jacket 60" further includes a middle layer 60*c*" of soft magnetic material and binding material which encases the metal shielding 60*a*" and drain wire 60*b*". The middle layer 60*c*" is preferably extruded over the metal shielding layer 60*a*" and has the same composition as the power cable insulation jacket inner layer 21".

Advantageously, the soft magnetic material of the middle layer 60*c*" functions as a common mode choke, converting any high frequency transients traveling along the metal shielding 60*a*" to heat and thereby protecting the integrity of signals transmitted on the one or more groups of signal conductors 30", 130", 230", 330", 430".

The outer jacket 60" additionally includes an outer layer 60*d*" comprised of an insulating material such as PVC. The outer layer 60*d*" functions to encapsulate and contain the middle layer 60*c*". Alternately, for applications where high temperature/fire resistance is needed, such as when the cable 10" is routed through overhead air plenums in office buildings, the outer layer 60*d*" may be a PTFE based compound which has high fire resistance properties.

Hybrid Cable—Fourth Preferred Embodiment

Figure 7:
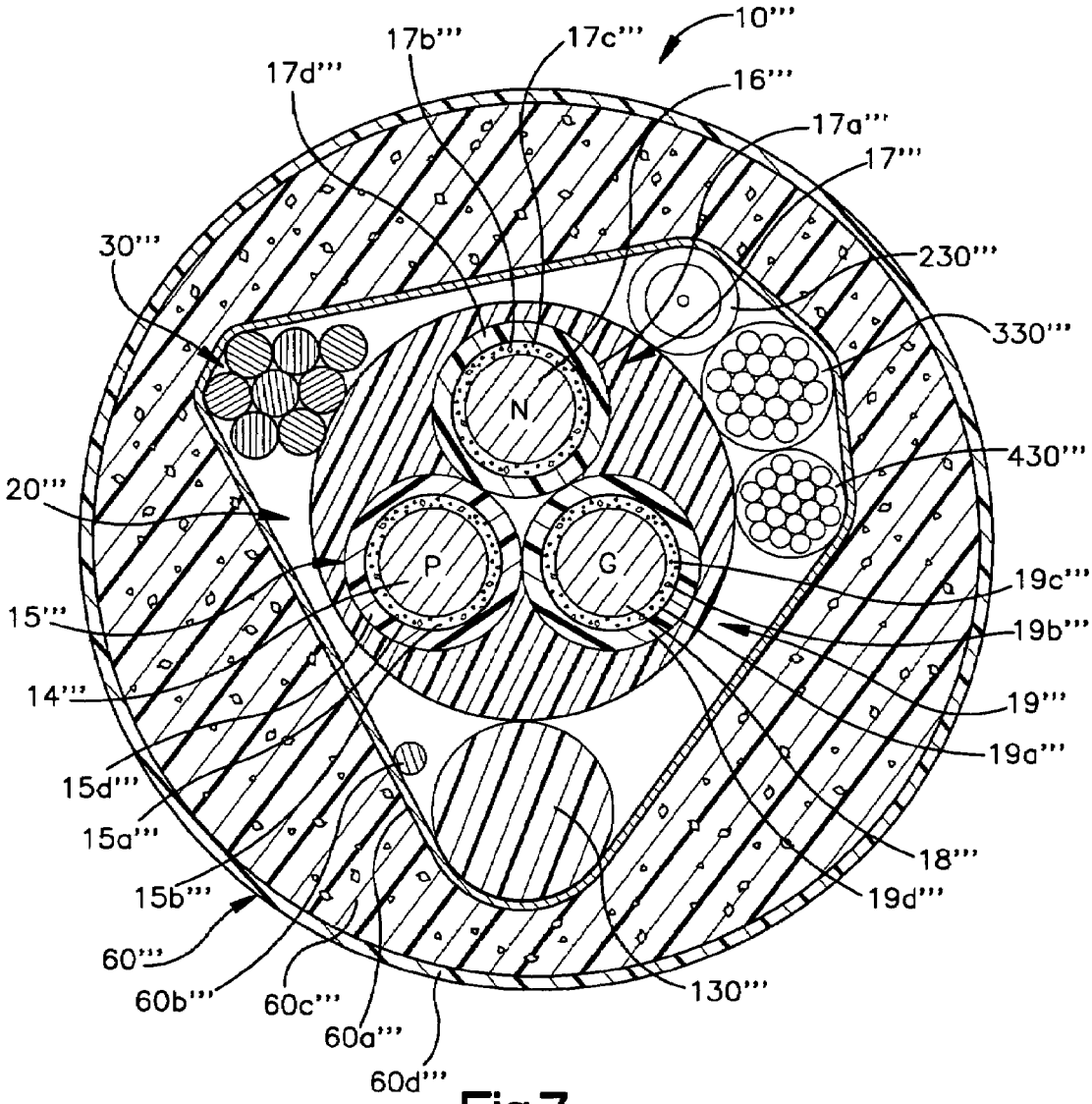
FIG. 7 is a schematic axial sectional view of a fourth preferred embodiment of a hybrid electrical cable of the present invention.

A fourth preferred embodiment of the hybrid cable of the present invention is shown generally at 10'" in FIG. 7. Fundamentally, the hybrid cable 10" of the third preferred embodiment is similar to the hybrid cable 10' of the second embodiment with additions to the outer jacket 60'. In the fourth embodiment, the hybrid cable 10" includes a power cable 12'" comprising a group of power conductors 13'". The hybrid cable 10'" also includes five groups of signal conductors 30'", 130'", 230'", 330'", 430'".

The group of power conductors 13'" includes the power conductor 14'", the neutral conductor 16'" and the isolated grounding conductor 18'". The power conductors 14'", 16'", 18'" are similar to the power conductors 14', 16', 18' described in the second embodiment. Each of the power conductors 14'", 16'", 18'" includes a respective power conductor insulation jacket 15'", 17'", 19'". Each of the power conductor insulation jackets 15'", 17'", 19'" includes an inner layer 15*a*'", 17*a*'", 19*a*'" and an outer layer 15*d*'", 17*d*'", 19*d*'".

The respective inner layers 15*a*'", 17*a*'", 19*a*'" of the power conductor insulation jackets 15'", 17'", 19'" comprise soft magnetic material 15*b*'", 17*b*'", 19*b*'" mixed or interspersed in a binder material 15*c*'", 17*c*'", 19*c*'". The soft magnetic material 15*b*'", 17*b*'", 19*b*'" is similar to the soft magnetic material 15*a*', 17*a*', 19*a*' described in the second embodiment, while the binder material 15*c*'", 17*c*'", 19*c*'" is similar to the binder material 15*c*', 17*c*', 19*c*' of the second embodiment. The outer layers 15*d*'", 17*d*'", 19*d*'" of the insulation jackets 15'", 17'", 19" are comprised of an insulating material such as the PVC material described with respect to the outer layers 15*d*', 17*d*', 19*d*' in the second embodiment.

Overlying the power conductor insulation jackets 15'", 17'", 19'" is an organic insulation jacket 20'", fabricated of PVC, nitrile rubber or other suitable insulation material. The hybrid cable 10'" also includes the five groups of signal conductors 30'", 130'", 230'", 330'", 430'". The first group of signal conductors 30'" includes four pair of twisted wire conductors. The second group of signal conductors 130'" includes an optical fiber conductor. The third group of signal conductors 230'" includes a coaxial cable. The forth and fifth groups of signal conductors 330'", 430'" include Cat5e data cables.

The hybrid electrical cable 10'" additionally includes a flexible outer jacket or sheath 60'" overlying the power cable 12'" and one or more groups of signal conductors 30'", 130'", 230'", 330'", 430'". The outer jacket 60'" includes an inner layer 60*a*'" of grounded metal shielding. The metal shielding 60*a*'" is a magnetic or paramagnetic material. Preferably, the metal shielding 60*a*'" is spirally wrapped around the power cable 12'" and the one or more groups of signal conductors 30'", 130'", 230'", 330'", 430'". To ground the metal shielding inner layer 60*a*'", a drain wire 60*b*'" may be electrically coupled to the metal shielding layer 60*a*'". Alternately, another means may be used to couple the metal shielding inner layer 60*a*'" to ground, for example, by crimping, soldering or welding the metal shielding 60*a*'" to ground.

The outer jacket 60'" further includes a middle layer 60*c*'" of soft magnetic material and binding material which encases the metal shielding 60*a*'" and drain wire 60*b*'". The middle layer 60*c*'" is preferably extruded over the metal shielding layer 60*a*'" and has the same composition as the power conductor insulation jacket inner layers 15*a*'", 17*a*'", 19*a*'". The outer jacket 60'" additionally includes an outer layer 60*d*'" comprised of an insulating material such as PVC or PTFE.

Testing of Soft Magnetic Material Surrounding a Power Cable

Empirical testing has proven the high frequency RF absorption capability of a soft magnetic material with regard to high voltage transients imposed on conductors of a power cable. Three configurations were tested. Configuration 1 was a 300 ft. length of 3AWG12 power cable which included three power conductors encased in a layer of soft magnetic material (which will be denoted as the "Simtra power cable"), skip bound with 300 ft of a Cat5E data cable. The Configuration 2 was a 300 ft. length of nonmetallic type B power cable (NMB—sold under the tradename ROMEX®), skip bound with 300 ft of a Cat5E data cable. Configuration 3 was a 300 ft. length of the THHN power cable (TWN75 FT1), skip bound with 300 ft of a Cat5E data cable.

Figure 8:
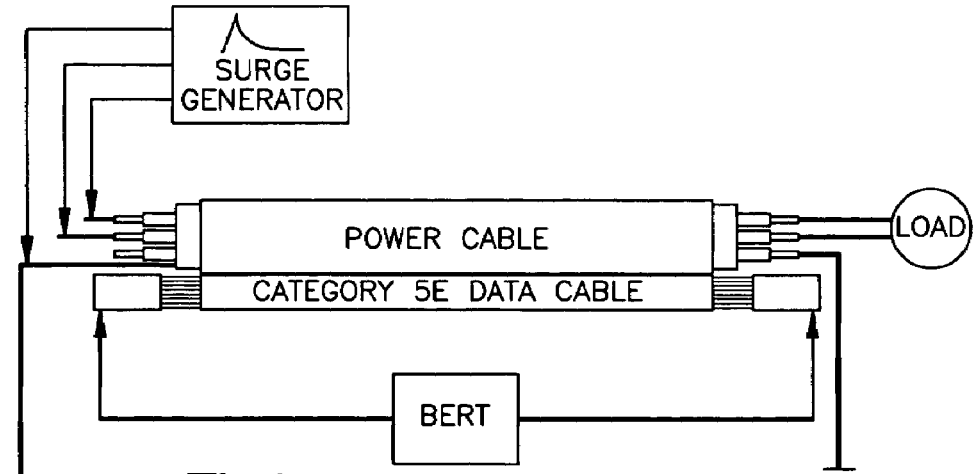
FIG. 8 is a schematic block diagram of a testing apparatus for an electrical fast transient test of a power cable coated with a soft magnetic material.

The purpose of the testing was to determine how levels of fast transients, as outlined in the standard BS EN 61000-4-4:1995, with variations in the voltage levels on the power cables affected data transmission in the Cat 5E cables. See FIG. 8 for a schematic representation of the test set up.

The Simtra, NMB and THHN power cables each were individually skip bound together with a Cat5E data cable. The data cable was terminated at a Bit Error Rate Tester (BERT) which transmitted data at 10 megabits per second (Mbps), 100 Mbps and 1000 Mbps. The power cables were energized with 120 VAC powering a 100 watt light bulb at the other end.

Electrical fast transients were induced in the power cables as outlined in the standard BS EN 61000-4-4:1995 with variations in the voltage levels. The BERT was monitored for errors (bit, symbol and idle) and transmission time lost (error seconds). Each test run was for seven minutes (420 second).

The electric fast transients were injected onto line, neutral and line, neutral and ground simultaneously. In each seven minute test interval, at 10 Mbs, there were 3,660,000,000 bits transmitted. At 100 Mbs, 36,600,000,000 bits were transmitted. At 1,000 MBS, 366,000,000,000 bits were transmitted.

FIG. 9 shows the test results in terms of total lost time in seconds (out of 420 seconds of data transmission time) due to data transmission errors for the various configurations at different transient voltages. If even one error was detected in a second interval, the entire second was counted as a lost time second. The remarks column shows some special configurations that were tested, where either the shield of the power cable was grounded or the whole conduit itself was grounded.

The Simtra cable exhibited little or no degradation of data transmission at all voltage levels with 10 and 100 Mbs data rates. The Simtra cable exhibited some degradation at 2500 V and 4400 V at the 1,000 Mbs data rate. The transient levels tested were representative and in excess of the environment typically found in commercial buildings. The traditional THHN and NMB cables exhibited significant degradation of data transmission at the 100 Mbs and 1000 Mbs data rates at all voltage levels.

Power Cable—First Preferred Embodiment

In spite of the obvious advantages of the hybrid cables 10, 10', 10" as disclosed above in terms of providing both high voltage power and low power signal transmissions in a single, unitary cable, there are situations, e.g., existing buildings, where metal or plastic conduit or raceways have already been installed and it would be highly beneficial and cost effective to route high voltage power conductors along of and adjacent to low power signal conductors within such conduit or raceways. A raceway is cable guidance mechanism that may fully or partially enclose conductors or cables running through it. A conduit is a type of raceway that fully encloses the conductors or cables running through it. The insulated high voltage, electrical power cable of the present invention is suitable for use adjacent low power signal conductors in conduit and in raceways. As mentioned above, high voltage power is defined as 30 V or more (AC or DC) while low power signal communications are defined as those communications and/or transmissions involving 5 watts or less of power.

In another aspect of the present invention, an insulated high voltage, electrical power cable is disclosed. The power cable uses a soft magnetic material surrounding the power cable power conductors. Since the soft magnetic material has the RF absorptive effect, as described above, the power cable of the present invention may advantageously be used for high voltage power transmission in a metal or plastic conduit or raceway systems in proximity to low power signal conductors.

Figure 11:
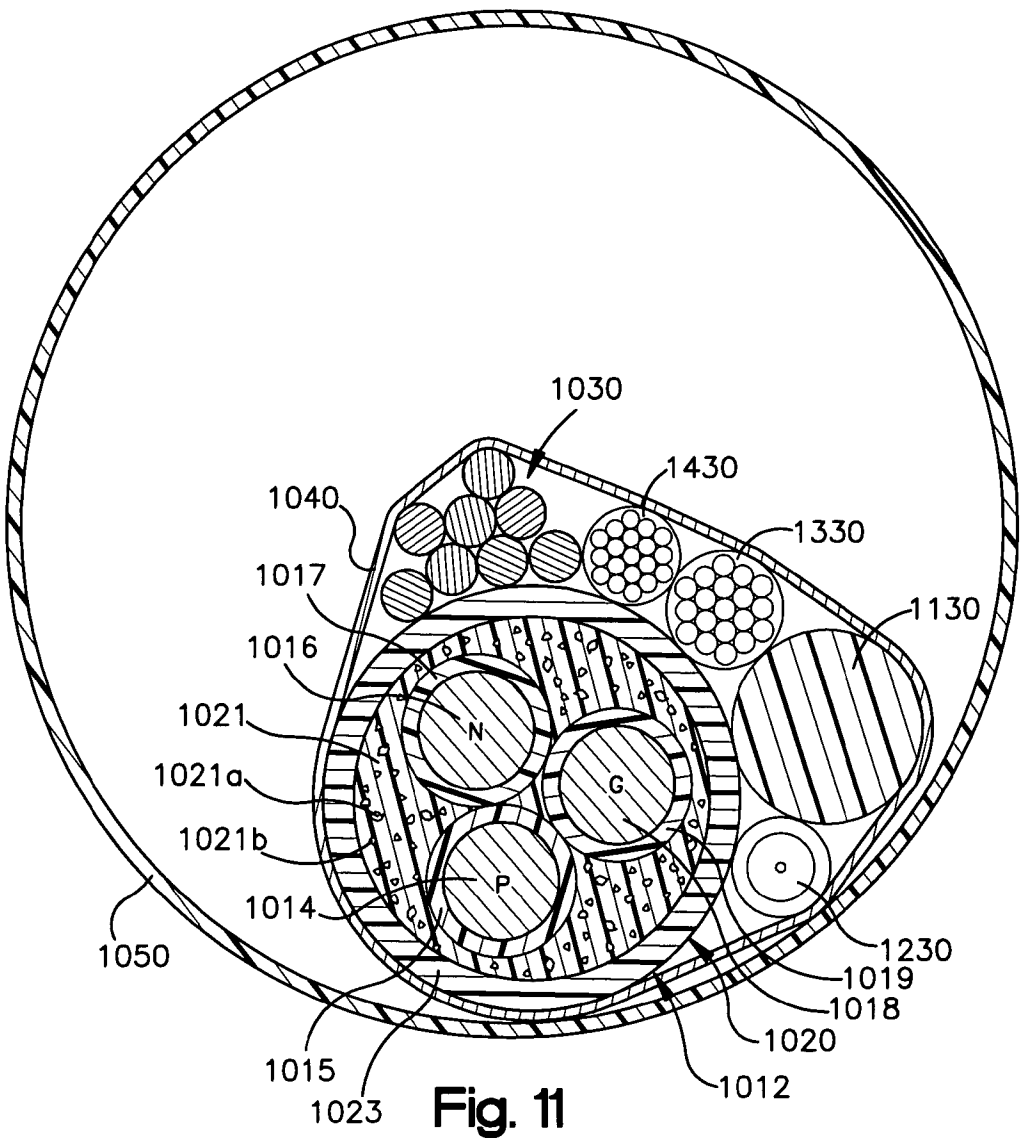
FIG. 11 is a schematic axial sectional view of the high voltage power cable of FIG. 10.
Figure 10:
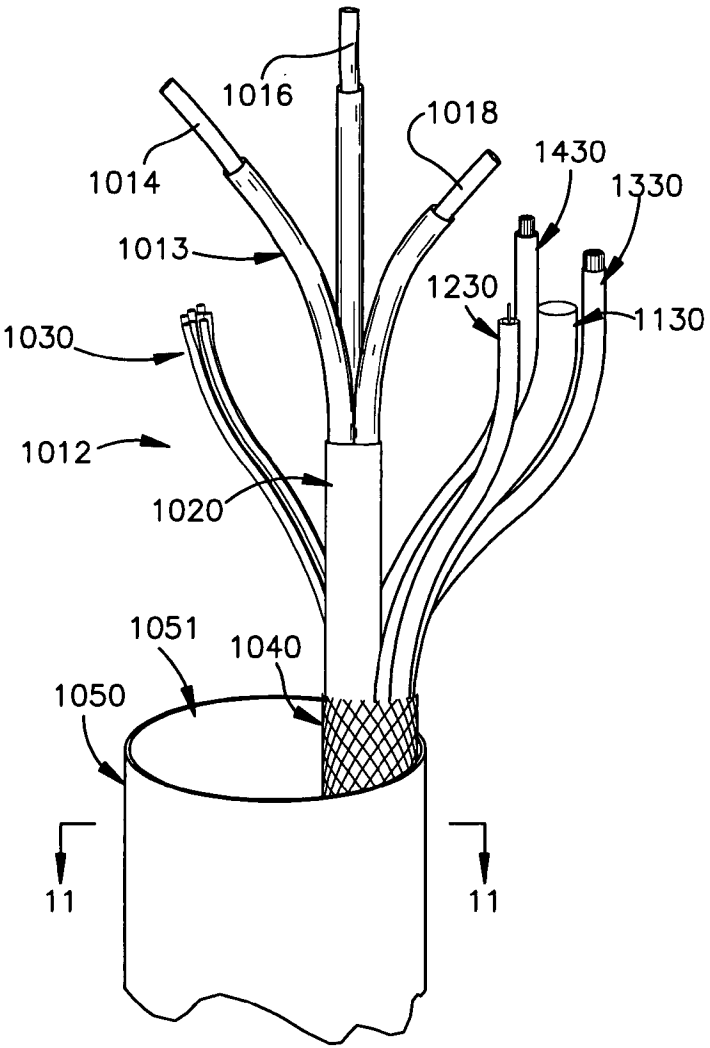
FIG. 10 is a schematic cut away view of a first embodiment of a high voltage electrical power cable of the present invention suitable for use in a section of conduit or raceway in proximity to one or more low power signal conductors.

A first preferred embodiment of a high voltage power cable of the present invention is shown generally at 1012 in FIGS. 10 and 11. As can be seen in FIG. 10, the power cable 1012 is disposed within a section of metal conduit or raceway 1050. Groups of low power signal conductors 1030, 1130, 1230, 1320 and 1420 are also disposed in the conduit 1050 adjacent to and extending along the power cable 1012. While the conduit 1050 shown in FIG. 10 is rigid metal conduit, it should be appreciated that the power conductor electrical cable 1012 may advantageously be used adjacent low power signal conductors 1030 disposed in flexible and rigid metal conduit, flexible and rigid non-metal conduit, and flexible and rigid metal and non-metal raceways.

As can best be seen in FIG. 11, the power cable 1012 is similar in structure to the power cable 12 in the first embodiment. The power cable 1012 includes a group of insulated conductors 1013. The group of conductors 1013 includes an insulated positive conductor 1014, an insulated neutral conductor 1016 and an insulated grounding conductor 1018. Each of the power conductors 1014, 1016, 1018 includes a respective insulation layer 1015, 1017, 1019 similar to the insulation layers 15, 17, 19 of the first hybrid cable embodiment.

The group of power conductors 1013 is encased in a power cable insulation jacket 1020, like the power cable insulation jacket 20 of the first hybrid cable embodiment. Specifically, the power cable insulation jacket 1020 includes an inner layer 1021 and an outer layer 1023. The inner layer 1021 is identical to the inner layer 21 of the first hybrid cable embodiment and includes a soft magnetic material 1021*a* mixed in a binder material 1021*b*. The soft magnetic material 1021*a* performs the RF absorbing function, as described in the first hybrid cable embodiment. The outer layer 1023 is identical to the outer layer 23 of the first hybrid cable embodiment and comprises an organic insulating material.

The thickness of the inner layer 1021 and the outer layer 1023 will depend on the application. Typical thickness of the inner layer and the outer layer may vary between 0.005–0.050 inch or more depending on the application.

Disposed within an interior region 1051 of the conduit 1050 are five groups of signal conductors 1030, 1130, 1230, 1330, 1430. The first group of signal conductors 1030 includes four pair of twisted wire conductors. The second group of signal conductors 1130 includes an optical fiber conductor. The third group of signal conductors 1230 includes a coaxial cable. The forth and fifth groups of signal conductors 1330, 1430 include Cat5e data cables.

As can be seen in FIG. 10, the high voltage power conductor electrical cable 1012 extends along and is adjacent to the groups of low power signal conductors 1030, 1130, 1230, 1330, 1430. The groups of low power signal conductors may advantageously include all types of digital and analog signal conductors known to those of skill in the art.

Although not required, for ease of installation, the power cable 1012 and the low power signal conductors 1030, 1130, 1230, 1330, 1430 may be bound together using a flexible wrapping or binding jacket 1040, similar to the wrapping jackets 40, 40' or 40" of the hybrid cable embodiments. The wrapping jacket 1040 may be a skip binding material fabricated from a polymer such as, for example, KEVLAR® thread. Alternately, the wrapping jacket 40'" may comprise a polymer tape material such as, for example, MYLAR® tape.

If the power cable 1012 is to be installed in a conduit or raceway wherein one or more groups of low power signal conductors are already routed through the conduit or raceway, then, obviously, the power cable 1012 would not be bundled with the signal conductors already in place. If the power cable 1012 and one or more groups of low power signal conductors are installed contemporaneously through a section of conduit or raceway, then prebundling the power cable and the one or more groups of signal conductors prior to installation is an option. Prebundling the power cable with the one or more groups of signal conductors prior to installation facilitates pulling or routing of the power cable 1012 and the one or more groups of signal conductors though the passageway defined by the conduit or raceway because it is more efficient to pull a single bundled group of all conductors through the conduit or raceway once than to repeatedly pull conductors through the conduit or raceway.

Power Cable—Second Preferred Embodiment

Figure 13:
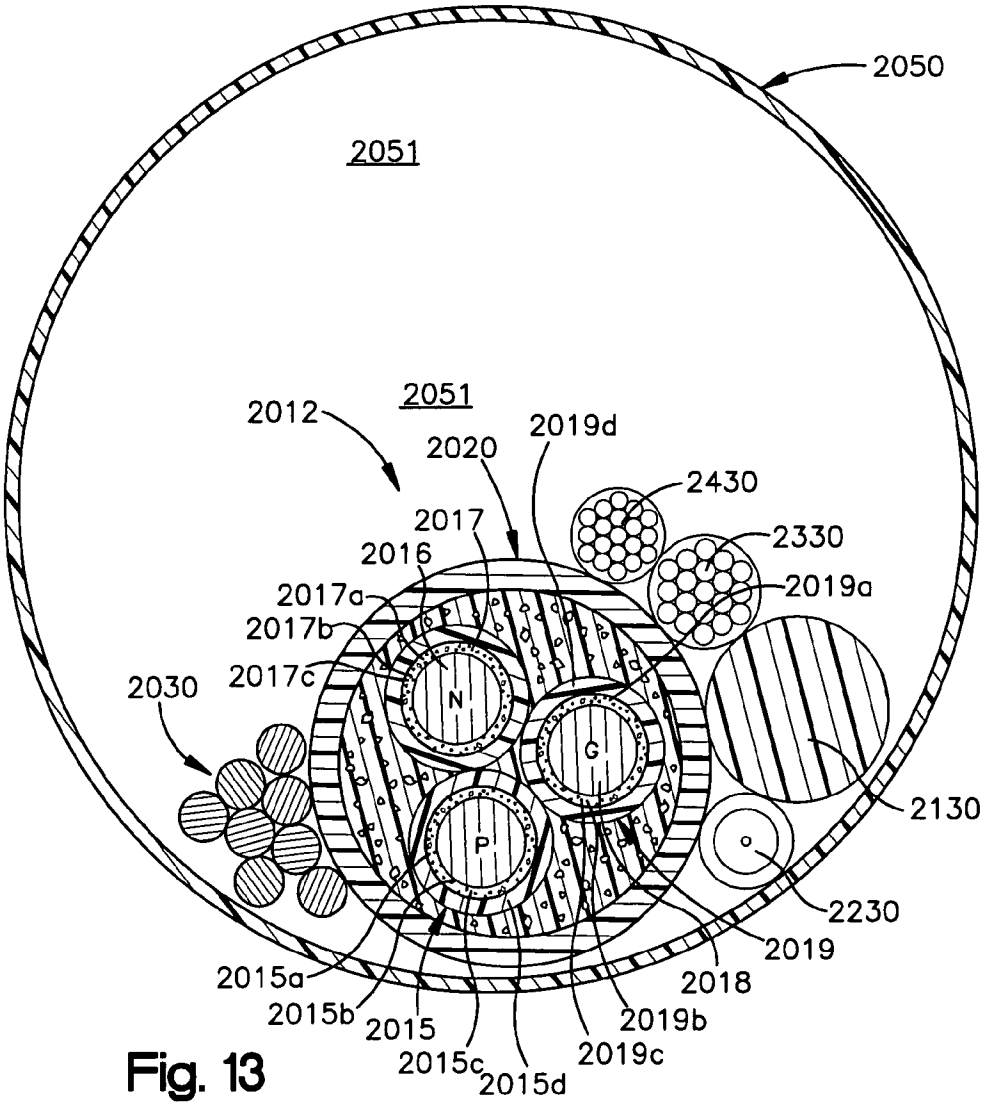
FIG. 13 is a schematic axial sectional view of the high voltage power cable of FIG. 12.
Figure 12:
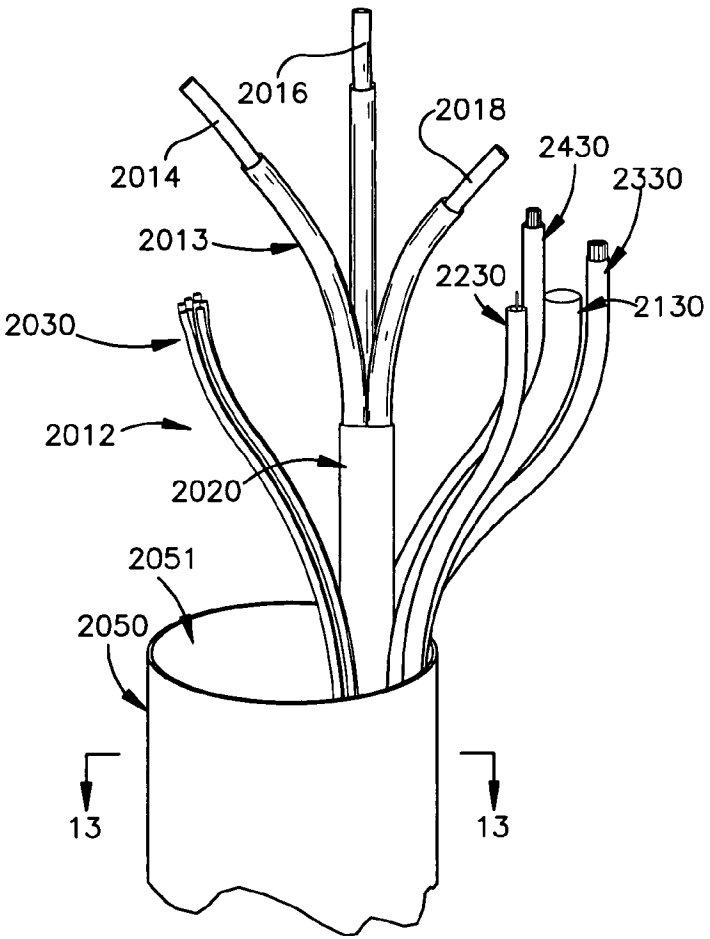
FIG. 12 is a schematic cut away view of a second embodiment of a high voltage electrical power cable of the present invention suitable for use in a section of conduit or raceway in proximity to one or more low power signal conductors.

A second preferred embodiment of a high voltage, electrical power cable of the present invention is shown generally at 2012 in FIGS. 12 and 13. As was the case with the first preferred embodiment of the power cable, the power cable 2012 is suitable for use within a metal or non-metal conduit or raceway 2050. The power cable 2012 extends longitudinally through an interior passageway 2051 defined by the conduit 2050 and is adjacent to and extends alongside of one or more groups of low power signal conductors 2030, 2130, 2230, 2330, 2430.

As can best be seen in FIG. 13, the power cable 2012 is similar in structure to the power cable 12' in the second hybrid cable embodiment. The power cable 2012 includes a group of conductors 2013 comprising a positive conductor 2014, a neutral conductor 2016 and a grounding conductor 2018. Each of the power conductors 2014, 2016, 2018 includes a respective insulation jacket 2015, 2017, 2019, like the power conductor insulation jackets 15', 17', 19' of the second hybrid cable embodiment. Specifically, each of the power conductor insulation jackets 2015, 2017, 2019 includes an inner layer 2015*a*, 2017*a*, 2019*a* and an outer layer 2015*d*, 2017*d*, 2019*d*.

The respective inner layers 2015*a*, 2017*a*, 2019*a* of the insulation jackets 2015, 2017, 2019 comprise soft magnetic material 2015*b*, 2017*b*, 2019*b* mixed or interspersed in a binder material 2015*c*, 2017*c*, 2019*c*. The soft magnetic material is the same as and performs the RF absorbing function as described with respect to the soft magnetic material 15*b*', 17*b*', 19*b*' of the second hybrid cable embodiment.

The insulation jackets 2015, 2017, 2019 perform the same shielding function as the insulation jacket 1020 of the first power cable embodiment, except that the insulation jackets 2015, 2017, 2019 individually encase the each of the power conductors 2014, 2016, 2018 instead of surrounding the group of three power conductors 2013.

One advantage of having the soft magnetic material layer 2015*a*, 2017*a*, 2019*a* individually surrounding each of the power conductors 2014, 2016, 2018 instead of the group of three power conductions as in the first power cable embodiment is manufacturing efficiency. Extruder nozzles are typically circular. Since the power conductors 2014, 2016, 2018 are circular in cross section, it is much easier and efficient for the circular extruder nozzle to apply a uniform inner layer 2015*a*, 2017*a*, 2019*a* of material over the circular cross section of the power conductors 2014, 2016, 2018. By contrast, in the first power cable embodiment, the power conductors 1014, 1016, 1018 form a generally triangular shape which leads to non-uniformity in the thickness of the inner soft magnetic layer 1021.

Further, the three power conductors 2014, 2016, 2018 do not run parallel but rather are twined or twisted around each other during the manufacturing process so that the conductors remain together during subsequent processing operations thus aggravating the non-uniformity problem or requiring that the extruder nozzle spin at the same rate or angular velocity as the rate or angular velocity of the twisting of the conductors around each other. Also, the coating of the individual conductors 2014, 2016, 2018 may result in more effective RF absorption in certain applications.

Overlying the power conductor insulation jackets 2015, 2017, 2019 is an organic insulation outer sheath or jacket 2060. The composition of the organic insulation jacket 2060 is similar to the composition of the outer layer 1023 of the first power cable embodiment.

The thickness of the power conductor insulation jacket inner layers 2015*a*, 2017*a*, 2019*a* and the outer layers 2015*d*, 2017*c*, 2019*d* will depend on the application. Typical thickness of the inner layers and the outer layers may vary between 0.005–0.100 inch depending on the application. The thickness of the outer sheath 2060 will also depend on the application. Typical thickness would be in the range of 0.005–0.030 inch.

Optionally, for ease of installation, in the conduit or raceway (not shown), the power cable 2012 and the low power signal conductors adjacent to and parallel with the power cable 2012 may be bound together using a flexible wrapping or binding jacket (not shown), similar to the binding jacket 1040 discussed with respect to the first power cable embodiment.

Power Cable—Third Preferred Embodiment

Figure 14:
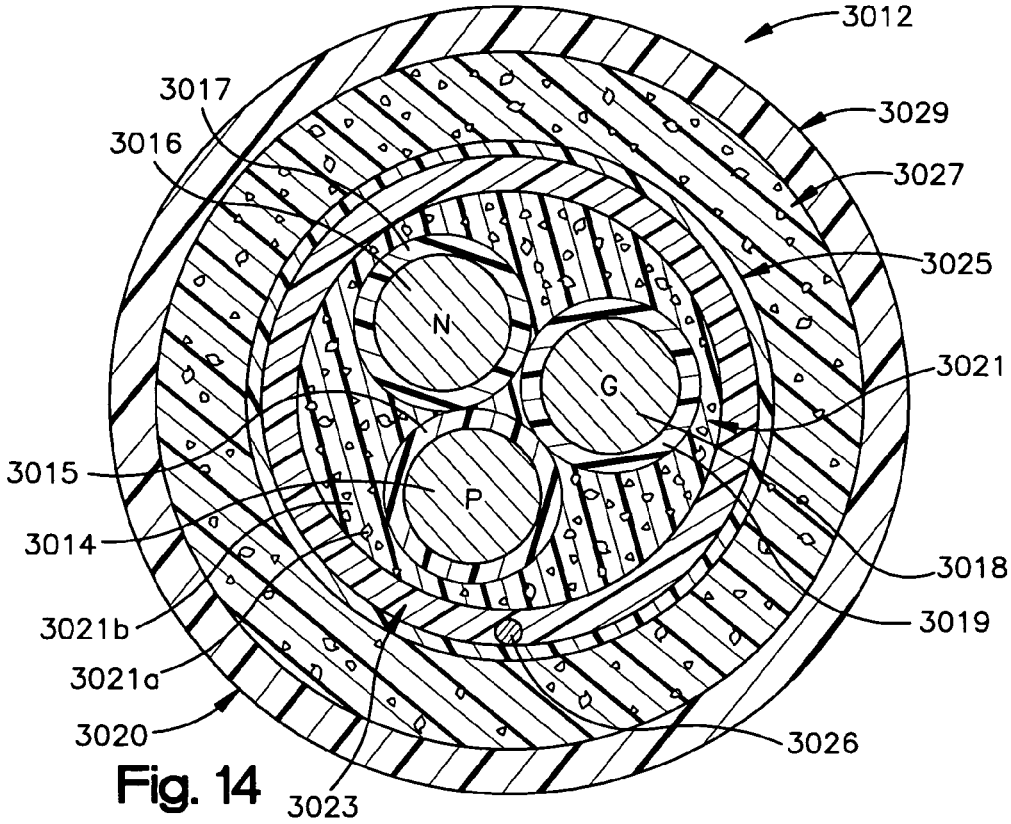
FIG. 14 is a schematic axial sectional view of a third embodiment of a high voltage electrical power cable of the present invention suitable for use in a section of conduit or raceway in proximity to one or more low power signal conductors.

A third preferred embodiment of the high voltage, electrical power cable of the present invention is shown generally at 3012 in FIG. 14. Fundamentally, the power cable 3012 of the third preferred embodiment is similar to the power cable 1012 of the first embodiment wherein the power cable insulation jacket 3020 includes additional layers including a grounded metallic wrap or layer 3024.

The power cable 3012 includes a group of power conductors 3013 comprising an insulated power conductor 3014, an insulated neutral conductor 3016 and an insulated isolated grounding conductor 3018. The power conductors 3014, 3016, 3018 are similar to the power conductors 14, 16, 18 described in the first hybrid cable embodiment. Each of the power conductors 3014, 3016, 3018 includes a respective insulation layer 3015, 3017, 3019 similar to the insulation layers 15, 17, 19 of the first hybrid cable embodiment.

The group of power conductors 3013 is encased in a power cable insulation jacket 3020 which includes a first layer 3021, a second layer 3023, a metallic third layer 3025, a fourth layer 3027 and an outer layer 3029. The inner layer 3021 is identical to the inner layer 21 of the first hybrid cable embodiment and includes a soft magnetic material 3021*a* mixed in a binder material 3021*b*. The second layer 3023 is identical to the outer layer 23 of the first hybrid cable embodiment and comprises an organic insulating material.

The power cable insulation jacket 3020 additionally includes the third layer 3025 of grounded metal shielding. The metal shielding 3025 is a magnetic or paramagnetic material. Preferably, the metal shielding 3025 is spirally wrapped around the second layer 3023. To ground the metal shielding layer 3025, a drain wire 3026 is electrically coupled to the metal shielding layer 3025. Alternately, the drain wire 3026 may be eliminated if another means is used to couple the metal shielding layer 3025 to ground, for example, by crimping, soldering or welding the metal shielding 3025 to ground.

The power cable insulation jacket 3020 further includes the fourth layer 3027 of soft magnetic material and binding material which encases the metal shielding 3025 and drain wire 3026. The fourth layer 3027 is preferably extruded over the metal shielding layer 3025 and has the same composition as the first layer 3021.

Advantageously, the soft magnetic material of the fourth layer 3027 functions as a common mode choke, converting any high frequency transients traveling along the metal shielding 3025 to heat and thereby protecting the integrity of signals transmitted on the one or more groups of signal conductors (not shown) disposed in the along side of the power cable 3010 within a section of metal or plastic conduit or raceway.

The power cable insulation jacket 3020 additionally includes an outer layer 3029 comprised of an insulating material such as PVC. The outer layer 3029 functions to encapsulate and contain fourth layer 3027. Alternately, for applications where high temperature/fire resistance is needed, the outer layer 3029 may be a PTFE based compound which has high fire resistance properties.

The thickness of the power cable insulation layers will depend on the application. Typical thickness of the first layer 3021 and the second layer 3023 may vary between 0.005–0.050 inch or more depending on the application. The metallic third layer 3025 may be typically between 0.050–0.020 inch thick. The thickness of the soft magnetic material fourth layer 3027 may be 0.005–0.050 inch or more depending on the application. The outer layer 3029 will typically be between 0.005–0.030 inch thick, depending on the application.

Optionally, for ease of installation, in the conduit or raceway (not shown), the power cable 3012 and the low power signal conductors adjacent to and parallel with the power cable 3012 may be bound together using a flexible wrapping or binding jacket (not shown), similar to the binding jacket 1040 discussed with respect to the first power cable embodiment.

Power Cable—Fourth Preferred Embodiment

Figure 15:
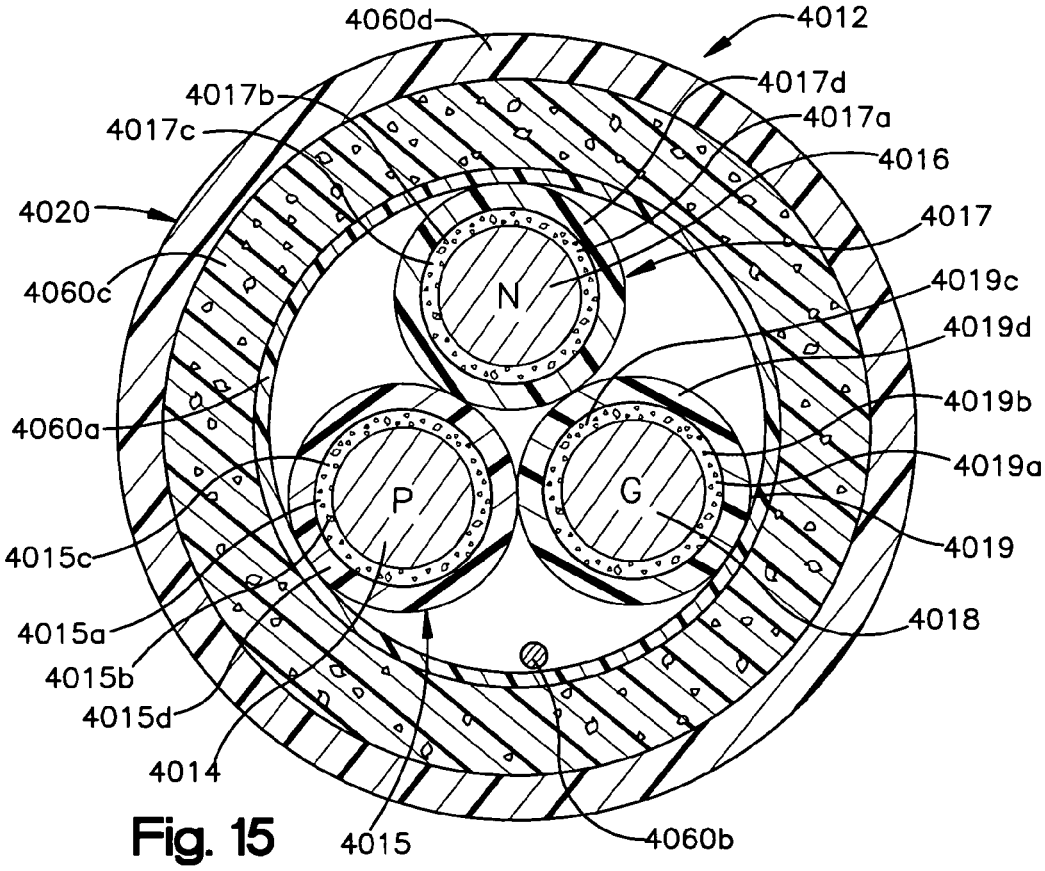
FIG. 15 is a schematic axial sectional view of a fourth embodiment of a high voltage electrical power cable of the present invention suitable for use in a section of conduit or raceway in proximity to one or more low power signal conductors.

A fourth preferred embodiment of the high voltage, electrical power cable of the present invention is shown generally at 4012 in FIG. 15. Fundamentally, the power cable 4012 of the fourth preferred embodiment is similar to the power cable 2012 of the second embodiment with additions to the outer jacket 2060. In the fourth embodiment, the power cable 4012 includes a group of power conductors 4013 comprising a power conductor 4014, a neutral conductor 4016 and an isolated grounding conductor 4018. The power conductors 4014, 4016, 4018 are similar to the power conductors 14', 16', 18' described in the second hybrid cable embodiment. Each of the power conductors 4014, 4016, 4018 includes a respective power conductor insulation jacket 4015, 4017, 4019. Each of the power conductor insulation jackets 4015, 4017, 4019 includes an inner layer 4015*a*, 4017*a*, 4019*a* and an outer layer 4015*d*, 4017*d*, 4019*d*.

The respective inner layers 4015*a*, 4017*a*, 4019*a* of the power conductor insulation jackets 4015, 4017, 4019 comprise soft magnetic material 4015*b*, 4017*b*, 4019*b* mixed or interspersed in a binder material 4015*c*, 4017*c*, 4019*c*. The soft magnetic material 4015*b*, 4017*b*, 4019*b* is similar to the soft magnetic material 2015*a*, 2017*a*, 2019*a* described in the second power cable embodiment, while the binder material 4015*c*, 4017*c*, 4019*c* is similar to the binder material 2015*c*, 2017*c*, 2019*c* of the second power cable embodiment. The outer layers 4015*d*, 4017*d*, 4019*d* of the insulation jackets 4015, 4017, 4019 are comprised of an insulating material such as the PVC material described with respect to the outer layers 2015*d*, 2017*d*, 2019*d* in the second power cable embodiment.

Overlying the power conductor insulation jackets 4015, 4017, 4019 is an outer sheath or jacket 4060. The outer sheath or jacket 4060 includes an inner layer 4060*a* of grounded metal shielding. The metal shielding 4060*a* is a magnetic or paramagnetic material. Preferably, the metal shielding 4060*a* is spirally wrapped around the power conductor insulation jackets 4015, 4017, 4019. To ground the metal shielding inner layer 4060*a*, a drain wire 4060*b* may be electrically coupled to the metal shielding layer 4060*a*. Alternately, another means may be used to couple the metal shielding inner layer 4060*a* to ground, for example, by crimping, soldering or welding the metal shielding 4060*a* to ground.

The outer jacket 4060 further includes a middle layer 4060*c* of soft magnetic material and binding material which encases the metal shielding 4060*a* and drain wire 4060*b*. The middle layer 4060*c* is preferably extruded over the metal shielding layer 4060*a* and has the same composition as the power conductor insulation jacket inner layers 4015*a*, 4017*a*, 4019*a*. The outer jacket 4060 additionally includes an outer layer 4060*d* comprised of an insulating material such as PVC or PTFE.

The thickness of the power conductor insulation jacket inner layers 4015*a*, 4017*a*, 4019*a* and the outer layers 4015*d*, 4017*c*, 4019*d* will depend on the application. Typical thickness of the inner layers and the outer layers may vary between 0.005–0.100 inch depending on the application. The thickness of the outer sheath 4060 will also depend on the application. The metallic shielding layer 4060*a* may be typically between 0.050–0.020 inch thick. The thickness of the soft magnetic material middle layer 4060*c* may be 0.005–0.050 inch or more depending on the application. The outer layer 4060*d* will typically be between 0.005–0.030 inch thick, depending on the application.

Optionally, for ease of installation, in the conduit or raceway (not shown), the power cable 4012 and the low power signal conductors adjacent to and parallel with the power cable 4012 may be bound together using a flexible wrapping or binding jacket (not shown), similar to the binding jacket 1040 discussed with respect to the first power cable embodiment.

While the present invention has been described with a degree of particularity, it is the intent that the invention includes all modifications and alterations from the disclosed embodiments falling within the spirit or scope of the appended claims.

We claim:

1. A combination of a high voltage, electrical power cable, a group of one or more low power signal conductors and a section of raceway defining a longitudinal passageway, the power cable and the group of one or more signal conductors installed within the section of raceway and extending together along at least a portion of the longitudinal passageway of the section of raceway, the combination comprising:

a) the section of raceway wherein the raceway is comprised of metal;

b) the group of one or more low power signal conductors disposed exterior of the power cable; and c) the power cable suitable for transmitting high voltage power and including a group of two or more power conductors and a power cable insulation jacket overlying the group of two or more power conductors, the power cable insulation jacket comprising a soft magnetic material having a coercivity of 1 oersted or less.

2. The combination of claim 1 wherein the soft magnetic material of the power cable insulation jacket comprises a soft ferrite magnetic material.

3. The combination of claim 2 wherein the soft ferrite magnetic material is embedded in an extrusible binder material and the power cable insulation jacket is extruded over the group of two or more power conductors to form a first layer.

4. The combination of claim 3 wherein the extrusible binder material is selected from a polymer material and an elastomer material.

5. The combination of claim 3 wherein the power cable insulation jacket further includes a second organic material insulation layer overlying the first layer.

6. The combination of claim 2 wherein the soft ferrite magnetic material of the power cable insulation jacket includes manganese zinc ferrite.

7. A combination of a high voltage, electrical power cable, a group of one or more low power signal conductors and a section of raceway defining a longitudinal passageway, the power cable and the group of one or more signal conductors installed within the section of raceway and extending together along at least a portion of the longitudinal passageway of the section of raceway, the combination comprising:

a) the section of raceway wherein the raceway is comprised of metal;

b) the group of one or more low power signal conductors disposed exterior of the power cable; and c) the power cable suitable for transmitting high voltage power and including a group of one or more power conductors and a power cable insulation jacket overlying the group of one or more power conductors, the power cable insulation jacket comprising a soft magnetic material having a coercivity of 1 oersted or less.

8. The combination of claim 7 wherein the soft magnetic material of the power cable insulation jacket comprises a soft ferrite magnetic material.

9. The combination of claim 8 wherein the soft ferrite magnetic material is embedded in an extrusible binder material and the power cable insulation jacket is extruded over the group of one or more power conductors to form a first layer.

10. The combination of claim 9 wherein the extrusible binder material is selected from a polymer material and an elastomer material.

11. The combination of claim 9 wherein the power cable insulation jacket further includes a second organic material insulation layer overlying the first layer.

12. The combination of claim 8 wherein the soft ferrite magnetic material of the power cable insulation jacket includes manganese zinc ferrite.

13. A combination of a high voltage, electrical power cable, a group of one or more low power signal conductors and a section of conduit defining a longitudinal interior region, the power cable and the group of one or more signal conductors installed within the section of conduit and extending together along at least a portion of the longitudinal interior region of the section of conduit, the combination comprising:

a) the section of conduit wherein the conduit is comprised of metal;

b) the group of one or more low power signal conductors disposed exterior of the power cable; and c) the power cable suitable for transmitting high voltage power and including a group of one or more power conductors and a power cable insulation jacket overlying the group of one or more power conductors, the power cable insulation jacket comprising a soft magnetic material having a coercivity of 1 oersted or less.

14. The combination of claim 13 wherein the soft magnetic material of the power cable insulation jacket comprises a soft ferrite magnetic material.

15. The combination of claim 14 wherein the soft ferrite magnetic material is embedded in an extrusible binder material and the power cable insulation jacket is extruded over the group of one or more power conductors to form a first layer.

16. The combination of claim 15 wherein the extrusible binder material is selected from a polymer material and an elastomer material.

17. The combination of claim 15 wherein the power cable insulation jacket further includes a second organic material insulation layer overlying the first layer.

18. The combination of claim 14 wherein the soft ferrite magnetic material of the power cable insulation jacket includes manganese zinc ferrite.

* * * * *